US010605239B2

(12) United States Patent
Uruma et al.

(10) Patent No.: US 10,605,239 B2
(45) Date of Patent: Mar. 31, 2020

(54) PUMP UNIT AND METHOD OF MANUFACTURING SAME

(71) Applicant: DAIKEN MEDICAL CO., LTD., Osaka (JP)

(72) Inventors: Masayuki Uruma, Osaka (JP); Yasunari Kabasawa, Osaka (JP); Eulhyun Kim, Osaka (JP)

(73) Assignee: DAIKEN MEDICAL CO., LTD., Osaka (JP)

( * ) Notice: Subject to any disclaimer, the term of this patent is extended or adjusted under 35 U.S.C. 154(b) by 326 days.

(21) Appl. No.: 15/550,901

(22) PCT Filed: Feb. 12, 2016

(86) PCT No.: PCT/JP2016/054178
§ 371 (c)(1),
(2) Date: Aug. 14, 2017

(87) PCT Pub. No.: WO2016/133024
PCT Pub. Date: Aug. 25, 2016

(65) Prior Publication Data

US 2018/0045191 A1 Feb. 15, 2018

(30) Foreign Application Priority Data

Feb. 17, 2015 (JP) ..... 2015-028889

(51) Int. Cl.
*F04B 43/04* (2006.01)
*F04B 43/02* (2006.01)

(52) U.S. Cl.
CPC ..... *F04B 43/046* (2013.01); *F04B 43/02* (2013.01); *F04B 43/021* (2013.01);
(Continued)

(58) Field of Classification Search
CPC .... F04B 43/046; F04B 43/043; F04B 43/021; F04B 43/02; F04B 43/04; F04B 39/1046; F04B 53/1077; F04B 53/22; F04B 43/028
See application file for complete search history.

(56) References Cited

U.S. PATENT DOCUMENTS 4,944,659 A * 7/1990 Labbe ..... A61M 5/14276 310/26
6,261,066 B1 7/2001 Linnemann et al.
(Continued)

FOREIGN PATENT DOCUMENTS

CN 1637292 7/2005
CN 101463808 6/2009
(Continued)

OTHER PUBLICATIONS

Extended European Search Report dated Jun. 21, 2018 in European Application No. 16752410.7.
(Continued)

*Primary Examiner* — Nathan C Zollinger
(74) *Attorney, Agent, or Firm* — Wenderoth, Lind & Ponack, L.L.P.

(57) ABSTRACT

The pump unit comprises a pump including a piezoelectric element and a discharge mechanism for discharging fluid according to operation of the piezoelectric element, and a valve mechanism attached to the pump. The discharge mechanism and the valve mechanism are separately formed by joining a plurality of metal layer pieces stacked in a predetermined stacking direction by diffusion welding, and are secured to each other by diffusion welding.

15 Claims, 30 Drawing Sheets

(52) U.S. Cl.
CPC ..... *F04B 43/028* (2013.01); *F04B 43/04* (2013.01); *F04B 43/043* (2013.01)

(56) References Cited

U.S. PATENT DOCUMENTS

| | | | | |
|---|---|---|---|---|
| 2005/0139002 | A1 | 6/2005 | Onishi | |
| 2005/0158188 | A1 | 7/2005 | Matsui et al. | |
| 2009/0159830 | A1* | 6/2009 | Chen | F04B 43/0009 251/356 |
| 2009/0232683 | A1* | 9/2009 | Hirata | F04B 43/046 417/413.2 |
| 2010/0290935 | A1* | 11/2010 | Richter | F04B 43/043 417/413.2 |
| 2011/0103980 | A1* | 5/2011 | Mandica | D06F 75/18 417/413.2 |
| 2013/0266461 | A1* | 10/2013 | Hirata | F04B 17/003 417/413.2 |
| 2014/0178227 | A1* | 6/2014 | Richter | F04B 39/10 417/470 |
| 2014/0248170 | A1* | 9/2014 | Kabasawa | F04B 43/043 417/472 |

FOREIGN PATENT DOCUMENTS

| | | |
|---|---|---|
| EP | 0 424 087 | 4/1991 |
| JP | 2008-180091 | 8/2008 |
| JP | 2011-256741 | 12/2011 |
| JP | 2013-117213 | 6/2013 |
| WO | 98/51929 | 11/1998 |
| WO | 2013/125364 | 8/2013 |
| WO | 2014/094879 | 6/2014 |

OTHER PUBLICATIONS

International Search Report dated May 17, 2016 in International (PCT) Application No. PCT/JP2016/054178.

* cited by examiner

PUMP UNIT AND METHOD OF MANUFACTURING SAME

TECHNICAL FIELD

The present invention relates to a pump unit including a positive displacement pump for discharging fluid by changing the volume in a pump chamber, and a valve mechanism for restricting flow of fluid through the pump when the pressure on the upstream side of the pump increases.

BACKGROUND ART

As an example of the above-mentioned pump unit, a micro pump assembly disclosed in Patent Document 1 is known.

The assembly includes a pump having a piezoelectric element and a discharge mechanism for discharging fluid according to operation of the piezoelectric element, a basal plate to which the pump is attached, and a gasket disposed between the pump and the basal plate.

The discharge mechanism includes a pump body, a pump side diaphragm defining a pump chamber in cooperation with the pump body, a flow-in valve that is disposed in a flow-in passage defined in the pump body and connecting with the pump chamber, and a flow-out valve that is disposed in a flow-out passage defined in the pump body and connecting with the pump chamber.

The pump-side diaphragm vibrates according to operation of the piezoelectric element to thereby repeatedly increase and reduce the volume of the pump chamber.

The flow-in valve opens when the pressure on the upstream side of the flow-in valve is greater than the pressure in the pump chamber. The flow-out valve opens when the pressure in the pump chamber is greater than the pressure on the downstream side of the flow-out valve.

Therefore, when the volume in the pump chamber increases owing to vibration of the pump-side diaphragm, the flow-in valve opens and the flow-out valve closes to suck fluid into the pump chamber through the flow-in passage. On the other hand, when the volume in the pump chamber decreases owing to vibration of the pump side diaphragm, the flow-in valve closes and the flow-out valve opens to cause fluid to flow out of the pump chamber through the flow-out passage.

As mentioned above, the flow-in valve and the flow-out valve open when the pressure on its upstream side is greater than the pressure on its downstream side, and therefore, when the pressure on the upstream side of the pump increases, fluid may undesirably be caused to flow out through the flow-out passage.

Accordingly, the basal plate includes a valve mechanism for restricting flow of fluid when the pressure in the flow-in passage increases.

Specifically, the valve mechanism includes a valve mechanism body having a flow-in side connection passage connecting with the flow-in passage, and a flow-out side connection passage connecting with the flow-out passage, and a valve side diaphragm disposed in the valve mechanism body and dividing the flow-in side connection passage from the flow-out side passage.

When the pressure in the flow-in side connection passage is greater than the pressure in the flow-out side connection passage, the pressure difference causes the valve side diaphragm to be pushed in a direction to close the flow-out side connection passage. Consequently, flow of fluid through the flow-out side passage is restricted when the pressure on the upstream side of the pump increases.

However, in the pump unit disclosed in Patent Document 1, the pump is attached to the valve mechanism (basal plate) via the gasket. The gasket is provided to seal the junction between the pump and the valve mechanism, and is formed by supplying uncured elastomer by screen printing and subsequently heating the uncured elastomer to cure it.

Thus, the provision of the gasket in the pump unit of Patent Document 1 results in increase in the number of components, and requires a step for forming the gasket in the joint between the pump and the valve mechanism, which makes a manufacturing process complicated.

CITATION LIST

Patent Literature

Patent Document 1: Japanese Unexamined Patent Publication No. 2013-117213

SUMMARY OF INVENTION

An object of the present invention is to provide a pump unit with a reduced number of components and capable of simplifying a manufacturing process thereof, and a method for manufacturing the pump unit.

In order to achieve the above-mentioned object, the present invention provides a pump unit, comprising: a pump including a piezoelectric element and a discharge mechanism for discharging fluid according to operation of the piezoelectric element; and a valve mechanism attached to the pump, wherein: the discharge mechanism includes a pump body, a pump side diaphragm defining a pump chamber in cooperation with the pump body, at least one flow-in valve that is disposed in a flow-in passage defined in the pump body and connecting with the pump chamber, and a flow-out valve that is disposed in a flow-out passage defined in the pump body and connecting with the pump chamber; the valve mechanism includes a valve mechanism body having a flow-in side connection passage connecting with the flow-in passage, and a flow-out side connection passage connecting with the flow-out passage, and a valve side diaphragm disposed in the valve mechanism body and dividing the flow-in side connection passage from the flow-out side connection passage; the flow-in valve is allowed to open when a pressure on an upstream side of the flow-in valve is greater than a pressure in the pump chamber; the flow-out valve is allowed to open when the pressure in the pump chamber is greater than a pressure on a downstream side of the flow-out valve; the valve side diaphragm is allowed to restrict flow of fluid through the flow-out side connection passage when a pressure in the flow-in side connection passage is greater than a pressure in the flow-out side connection passage; and the discharge mechanism and the valve mechanism each include a plurality of metal layer pieces stacked in a predetermined stacking direction and joined to one another by diffusion welding, the discharge mechanism and the valve mechanism being secured to each other by diffusion welding.

Further, a pump unit manufacturing method according to the present invention comprises: a preparation step of preparing a plurality of metal layer pieces for forming the discharge mechanism and the valve mechanism; a joining step of joining the plurality of metal layer pieces by diffusion welding; and an attachment step of attaching the piezoelectric element to the discharge mechanism.

According to the present invention, it is possible to provide a pump unit with a reduced number of components and to simplify a manufacturing process of the pump unit.

DESCRIPTION OF EMBODIMENTS

Hereinafter, embodiments of the present invention will be described with reference to the accompanying drawings. It should be noted that the following embodiments illustrate examples of the invention, and do not limit the protection scope of the invention.

First Embodiment (FIGS. 1 to 12)

Figure 1:
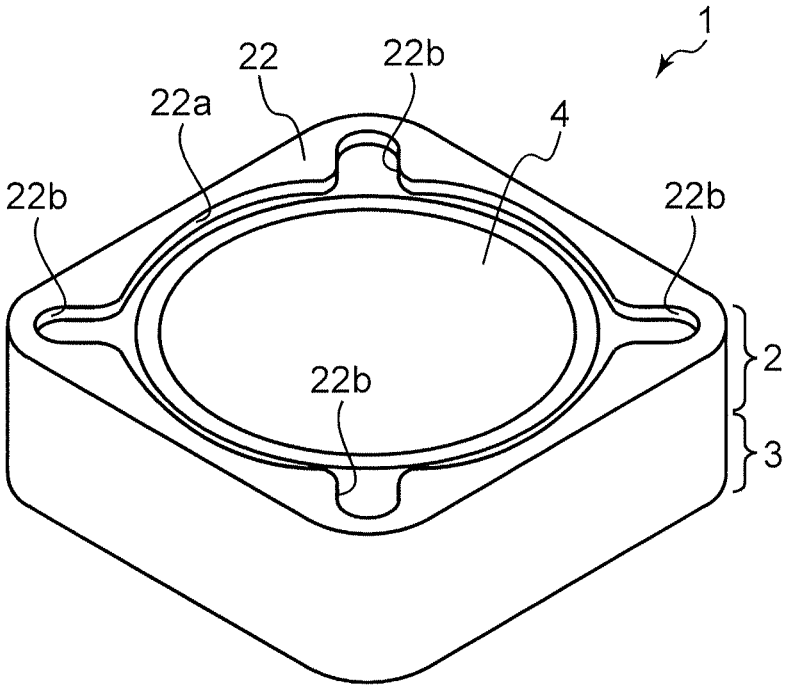
FIG. 1 is a perspective view showing an overall configuration of a pump unit according to a first embodiment of the present invention.
Figure 2:
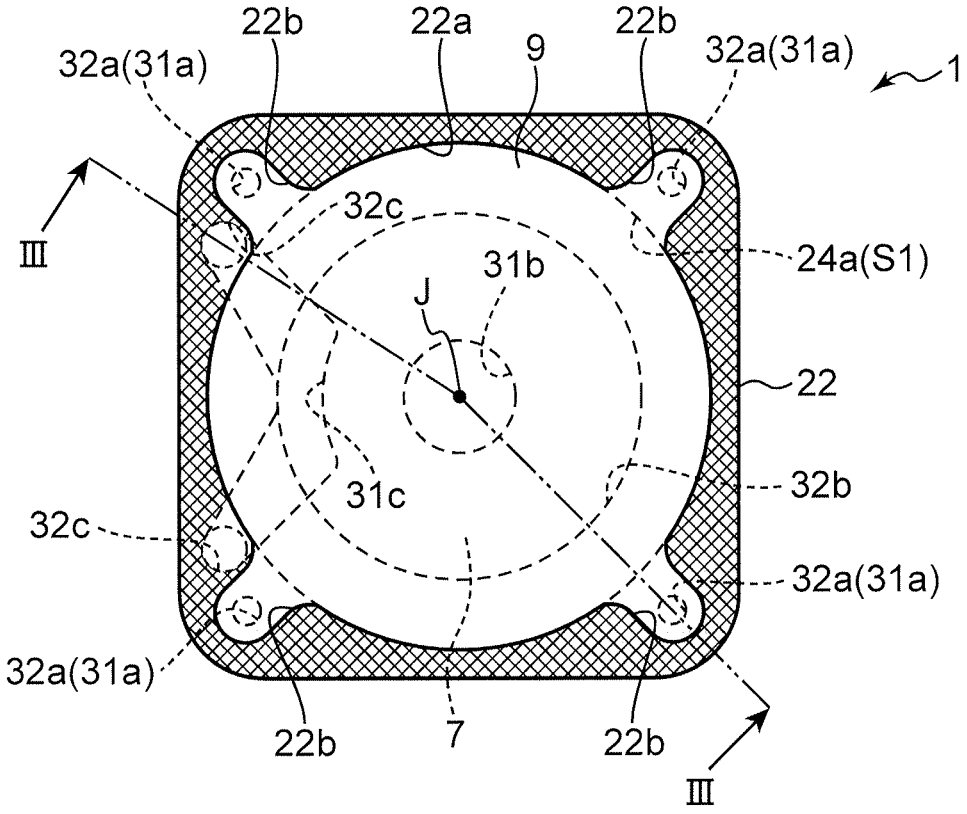
FIG. 2 is a plan view of the pump unit shown in FIG. 1.

A pump unit 1 according to a first embodiment of the present invention will be described with reference to FIGS. 1 to 3. It should be noted that FIG. 2 is a plan view of the pump unit 1 shown in FIG. 1 with a piezoelectric element 4 removed.

The pump unit 1 includes a pump 2 for discharging fluid, and a valve mechanism 3 for restricting flowing out of fluid through the pump 2 when the pressure of fluid on the upstream side of the pump 2 increases.

The pump 2 includes the piezoelectric element 4 and a discharge mechanism 5 for discharging fluid according to operation of the piezoelectric element 4.

Figure 3:
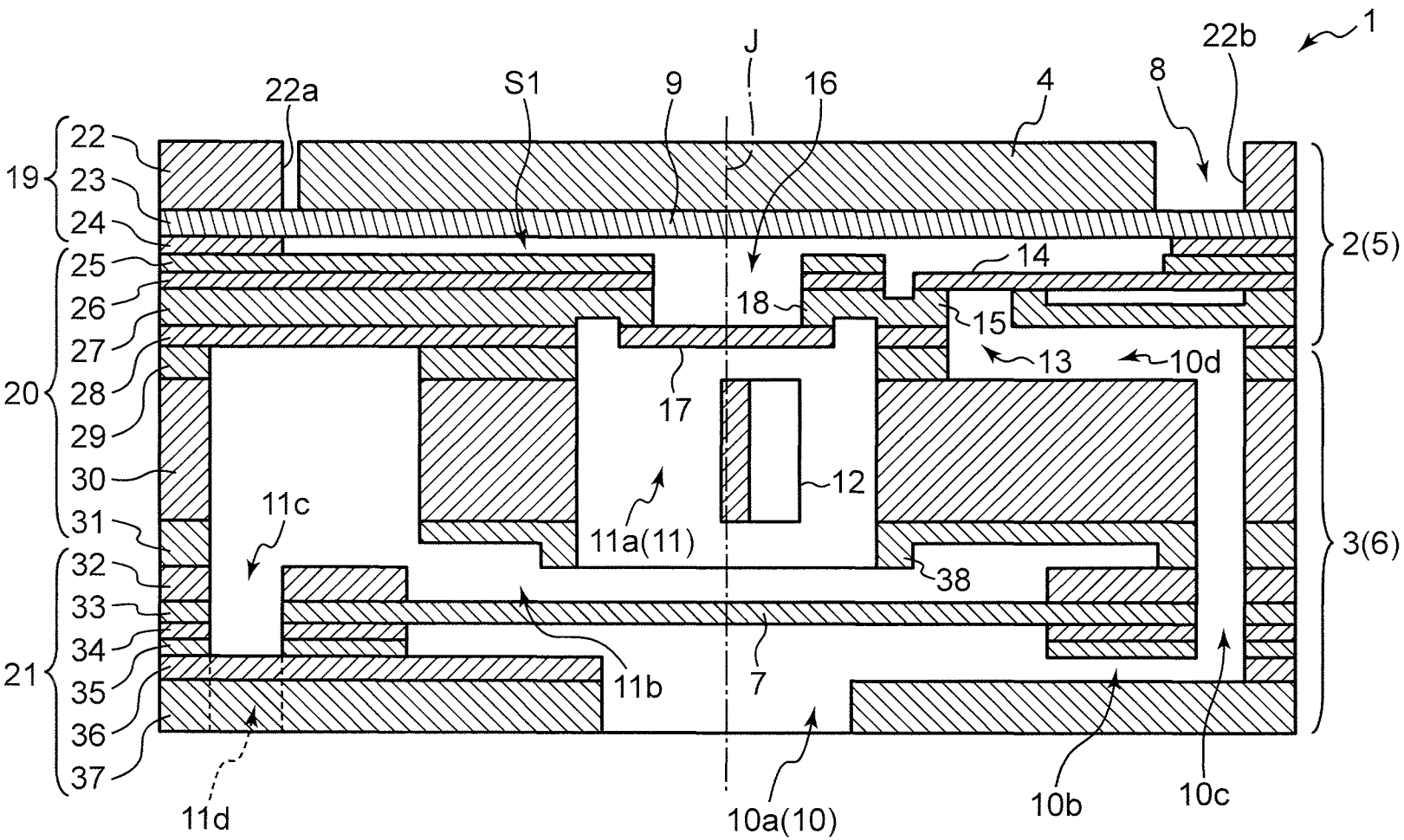
FIG. 3 is a sectional view taken along the line III-III in FIG. 2.

The discharge mechanism 5 includes a pump body 8, a pump side diaphragm 9 defining a pump chamber S1 in cooperation with the pump body 8, four flow-in valves 14 that are respectively disposed in flow-in passages (only one of which is shown in FIG. 3) 13 formed in the pump body 8 and connecting with the pump chamber S1, and a flow-out valve 17 that is disposed in a flow-out passage 16 formed in the pump body 8 and connecting with the pump chamber S1.

The pump chamber S1 is a space (see FIG. 2) having a substantially circular shape in plan view. The flow-out passage 16 is connected to a center of the pump chamber S1 in the plan view. The four flow-in passages 13 are provided at every 90 degrees around a central axis J (see FIG. 3) of the pump chamber S1. Each flow-in passage 13 has, in the plan view looking at the pump unit 1 along the central axis J (axis extending in a stacking direction of metal layer pieces 22 to 37 described later), a portion lying inside the pump chamber S1 and a portion lying outside the pump chamber S1. The flow-out passage 16 lies inside the pump chamber S1 in the plan view.

The pump body 8 includes flow-in valve seats 15 for closing the flow-in passages 13 in cooperation with the flow-in valves 14, and a flow-out valve seat 18 for closing the flow-out passage 16 in cooperation with the flow-out valve 17.

When the pressure on the upstream side of the flow-in valve 14 is equal to or smaller than the pressure in the pump chamber S1, the flow-in valve 14 comes into close contact with the flow-in valve seat 15 to close the flow-in passage 13. On the other hand, when the pressure on the upstream side of the flow-in valve 14 is greater than the pressure in the pump chamber S1, the flow-in valve 14 resiliently deforms to separate from the flow-in valve seat 15 to open the flow-in passage 13.

When the pressure in the pump chamber S1 is equal to or smaller than the pressure on the downstream side of the flow-out valve 17, the flow-out valve 17 comes into close contact with the flow-out valve seat 18 to close the flow-out passage 16. On the other hand, when the pressure in the pump chamber S1 is greater than the pressure on the downstream side of the flow-out valve 17, the flow-out valve 17 resiliently deforms to separate from the flow-out valve seat 18 to open the flow-out passage 16.

The valve mechanism 3 includes a valve mechanism body 6 having a flow-in side connection passage 10 connecting with the flow-in passages 13 of the pump 2 and a flow-out side connection passage 11 connecting with the flow-out passage 16 of the pump 2, and a valve side diaphragm 7 disposed in the valve mechanism body 6 and dividing the flow-in side connection passage 10 from the flow-out side connection passage 11.

The valve side diaphragm 7 is disposed concentrically with the pump side diaphragm 9, and disposed inside the pump chamber S1 in the plan view (see FIG. 2). Further, the valve side diaphragm 7 is disposed in parallel to the pump side diaphragm 9. Each of the flow-in passages 13 and the flow-out passage 16 of the pump 2 is disposed between the diaphragms 7 and 9.

The flow-in side connection passage 10 extends from the flow-in passages 13 of the pump 2 to a position on the opposite side of the valve side diaphragm 7 from the pump 2 while bypassing the valve side diaphragm 7, and is open at an end surface of the valve mechanism body 6 on the opposite side from the pump 2.

Specifically, the flow-in side connection passage 10 includes four connected portions (only one of which is shown in FIG. 3) 10*d* respectively connecting with the four flow-in passages 13 of the pump body 8, first extension portions 10*c* each extending from an end portion of the connected portion 10*d* that lies furthest from the central axis J, the first extension portions 10*c* extending in parallel to the central axis J, second extension portions 10*b* each extending from the first extension portion 10*c* in a direction toward the central axis J, and a flow-in portion 10*a* connecting with the four second extension portions 10*b*. Thus, fluid caused to flow in through the flow-in portion 10*a* flows separately to the four second extension portions 10*b* to be guided to the flow-in passages 13 of the pump 2 through the second extension portions 10*b*, the first extension portions 10*c* and the connected portions 10*d*.

Here, in the flow-in side connection passage 10, part of each connected portion 10*d*, the entirety of the first extension portions 10*c*, and part of each second extension portion 10*b* lie outside the pump chamber S in the plan view, and the other part lies inside the pump chamber S1 in the plan view.

On the other hand, the flow-out side connection passage 11 extends from the flow-out passage 16 of the pump 2 toward the valve side diaphragm 7, then extends along a surface of the valve side diaphragm 7 in a direction away from the central axis J, and then passes by the valve side diaphragm 7 to open at an end surface of the valve mechanism body 6 opposite from the pump 2.

Specifically, the flow-out side connection passage 11 includes a connected portion 11*a* connecting with the flow-out passage 16 of the pump body 8, a first extension portion 11*b* extending from an end of the connected portion 11*a* that lies closer to the valve side diaphragm 7 in the direction away from the central axis J, two second extension portions (only one of which is shown in FIG. 3) 11*c* each connecting with an end of the first extension portion 11*b* that lies farther from the central axis J and extending in parallel to the central axis J, and a flow-out portion 11*d* merging the extension portions 11*c*. Fluid caused to flow out of the pump chamber S1 to the connected portion 11*a* flows separately to the two second extension portions 11*c* through the first extension portion 11*b*, and the two flows merge at the flow-out portion 11*d* to be caused to flow out. In addition, in the connected portion 11*a*, a stopper 12 is provided for holding the flow-out valve 17 at a predetermined open position when the flow-out valve 17 is open.

Here, in the flow-out side connection passage 11, part of the first extension portion 11*b*, the entirety of the second extension portions 11*c*, and part of the flow-out portion 11*d* lie outside the pump chamber S1 in the plan view, and the other part lies inside the pump chamber S1 in the plan view.

The valve side diaphragm 7 functions as a wall that defines part of the flow-in side connection passage 10 (part of the flow-in portion 10*a* and the second extension portions 10*b*), and also functions as a wall that defines part of the flow-out side connection passage 11 (part of the connected portion 11*a* and the extension portion 11*b*).

Further, the valve mechanism body 6 includes a valve seat 38 operable to come into contact with the valve-side diaphragm 7 to thereby restrict flow of fluid through the flow-out side connection passage 11.

The valve side diaphragm 7 is spaced from the valve seat 38. Further, the valve side diaphragm 7 has an elasticity to resiliently deform to come into contact with the valve seat 38 when the pressure in the flow-in side connection passage 10 is equal to or greater than a predetermined reference pressure that is greater than the pressure in the flow-out side connection passage 11.

Therefore, fluid is permitted to flow through the flow-out side connection passage 11 when the pressure in the flow-in side connection passage 10 is smaller than the reference pressure, and the flow of fluid through the flow-out side connection passage 11 is restricted when the pressure in the flow-in side connection passage 10 is equal to or greater than the reference pressure.

Hereinafter, operation of the pump unit 1 will be described with reference to FIGS. 3 to 6.

In a stopped state of the pump unit 1 shown in FIG. 3, an alternating current power is supplied to the piezoelectric element to cause the pump side diaphragm 9 to vibrate with the operation of the piezoelectric element.

Figure 4:
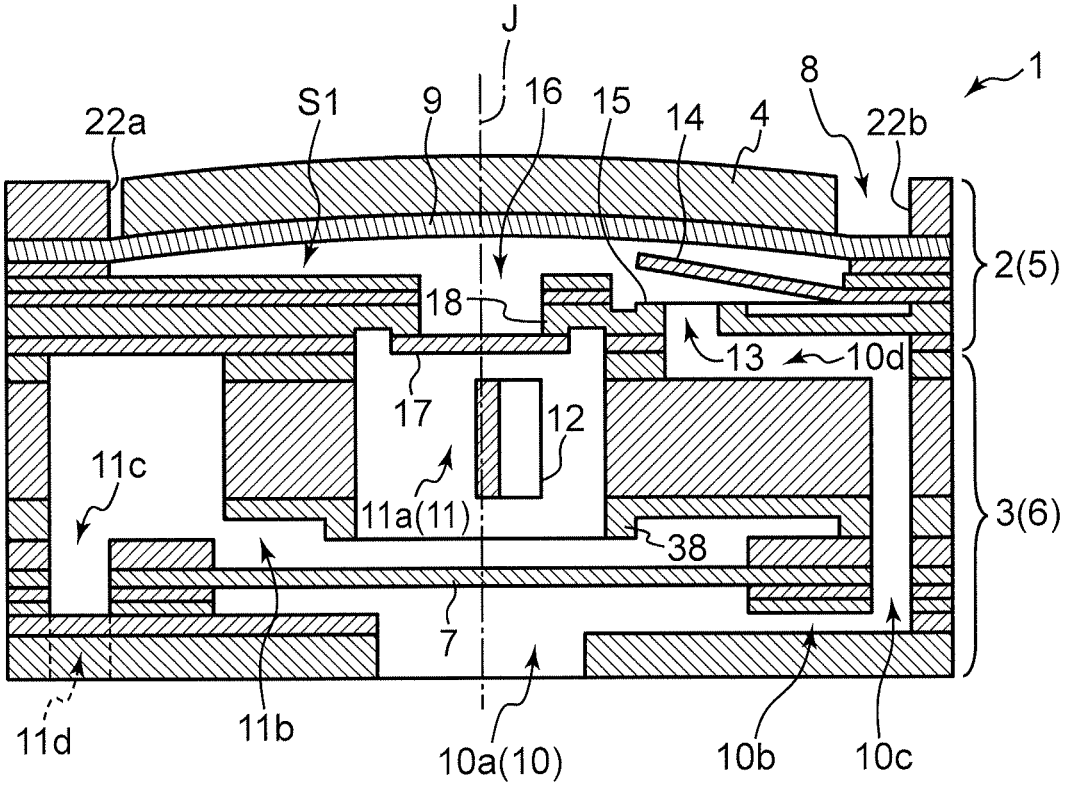
FIG. 4 is a sectional view showing operation of the pump unit shown in FIG. 2, the view showing a state in which fluid has been caused to flow into a pump chamber.

Specifically, as shown in FIG. 4, when the pump side diaphragm 9 shifts in a direction to expand the pump chamber S1, the pressure on the upstream side of the flow-in valve 14 becomes greater than the pressure in the pump chamber S1 to allow the flow-in valve 14 to open, while the pressure in the pump chamber S1 becomes smaller than the pressure on the downstream side of the flow-out valve 17 to allow the flow-out valve 17 to close. This allows fluid to flow into (be sucked into) the pump chamber S1.

Figure 5:
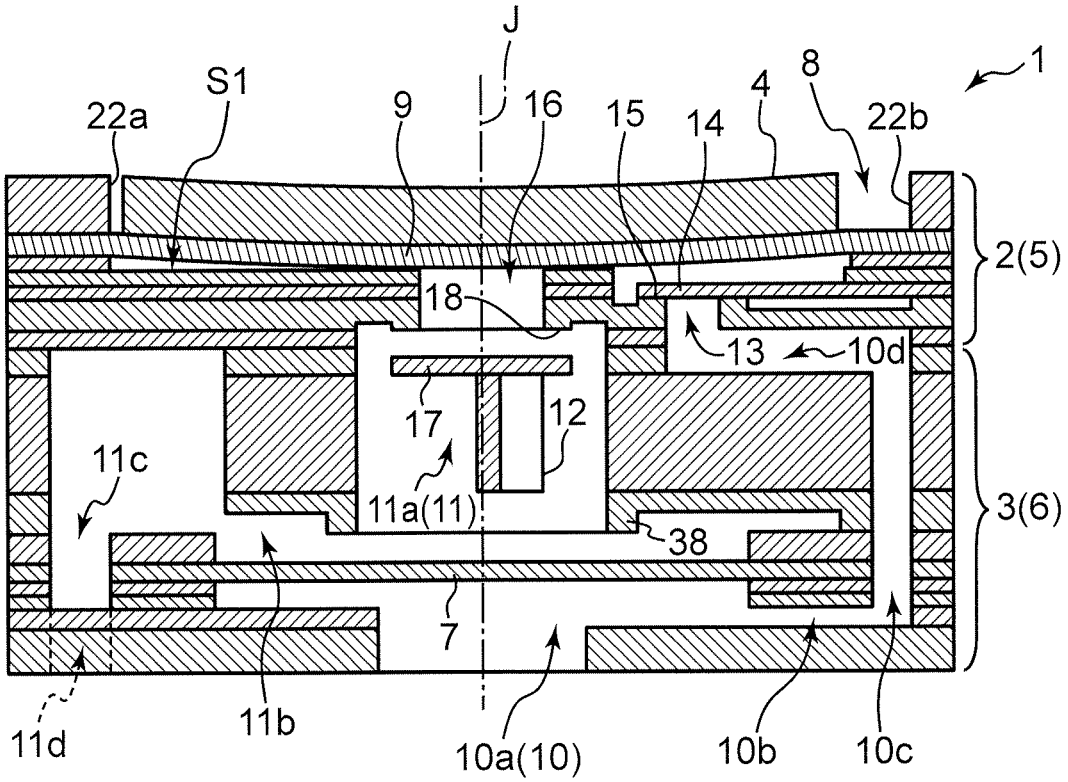
FIG. 5 is a sectional view showing the operation of the pump unit shown in FIG. 2, the view showing a state in which fluid has been caused to flow out of the pump chamber.

On the other hand, as shown in FIG. 5, when the pump side diaphragm 9 shifts in a direction to contract the pump chamber S1, the pressure on the upstream side of the flow-in valve 14 becomes smaller than the pressure in the pump chamber S1 to allow the flow-in valve 14 to close, while the pressure in the pump chamber S1 becomes greater than the pressure on the downstream side of the flow-out valve 17 to allow the flow-out valve 17 to open. This allows fluid to flow out of the pump chamber S1.

Here, a space is defined between the valve side diaphragm 7 and the valve seat 38. Therefore, it is possible to prevent a pressure loss when fluid is caused to flow out, unlike a case where the valve side diaphragm 7 is disposed in close contact with the valve seat 38 in advance in such a way as to open when the pressure in the flow out side connection passage 11 increases.

Figure 6:
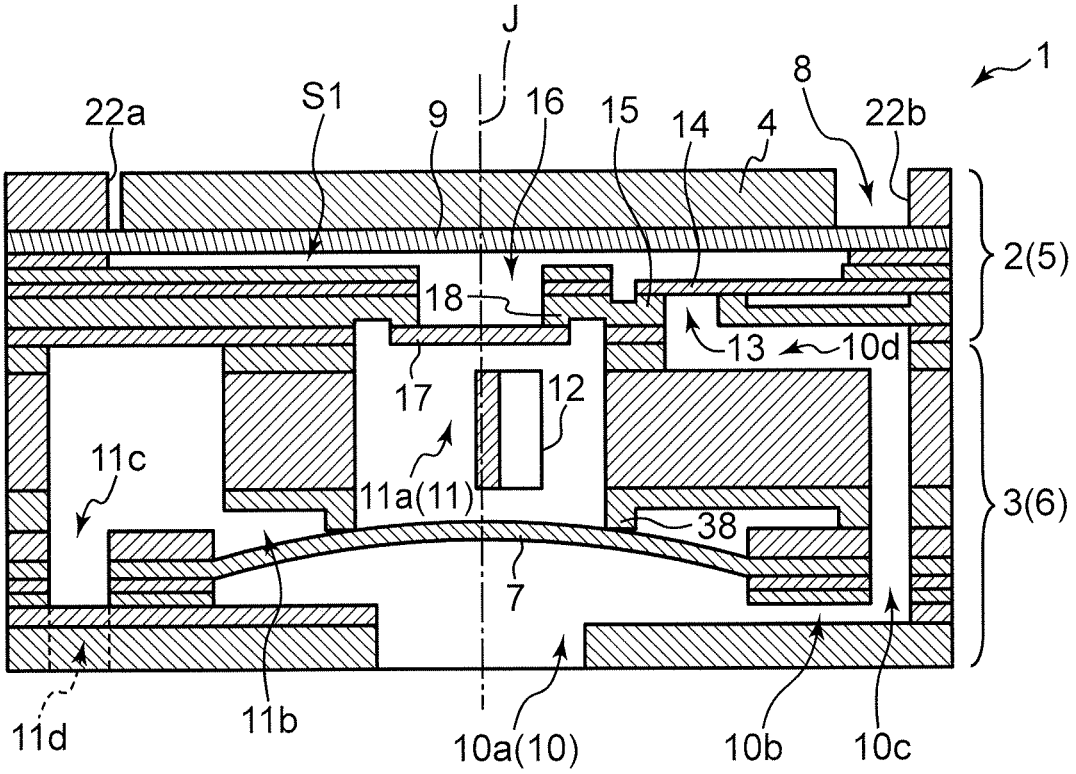
FIG. 6 is a sectional view showing the operation of the pump unit shown in FIG. 2, the view showing a state in which the flowing out of fluid is restricted by a valve side diaphragm.

Further, as shown in FIG. 6, when the pressure in the flow-in side connection passage 10 becomes equal to or greater than the reference pressure, the valve side diaphragm 7 resiliently deforms to come into close contact with the valve seat 38, to thereby restrict flow of fluid through the flow-out side connection passage 11.

It should be noted that the opposite sides of the valve side diaphragm 7 are set to have equal pressure receiving areas, but the valve side diaphragm 7 resiliently deforms reliably when the pressure in the flow-in side connection passage 10 becomes equal to or greater than the reference pressure. The reason is that a pressure loss occurs in the flow-in side connection passage 10 itself and in opening of the flow-in valve 14 and the flow-out valve 17, which creates a pressure difference corresponding to the reference pressure between the flow-in side connection passage 10 and the flow-out side connection passage 11. The opening area of the valve seat 38 is smaller than the pressure receiving area of the side of the valve side diaphragm 7 that is closer to the flow-in side connection passage 10, and therefore, in a state in which the valve side diaphragm 7 is in close contact with the valve seat 38, a force acts in a direction to push the valve side diaphragm 7 against the valve seat 38 according to the difference in the pressure receiving area between the flow-in side and the flow-out side of the valve side diaphragm 7.

As shown in FIG. 3, the discharge mechanism 5 and the valve mechanism 3 of the pump unit 1 are separately formed by joining the plurality of metal layer pieces 22 to 37 stacked in the stacking direction coincident with the central axis J by diffusion welding, and are secured to each other by diffusion welding.

Specifically, the discharge mechanism 5 is formed by the metal layer pieces 22 to 28, and the valve mechanism 3 is formed by the metal layer pieces 29 to 37.

Figure 8:
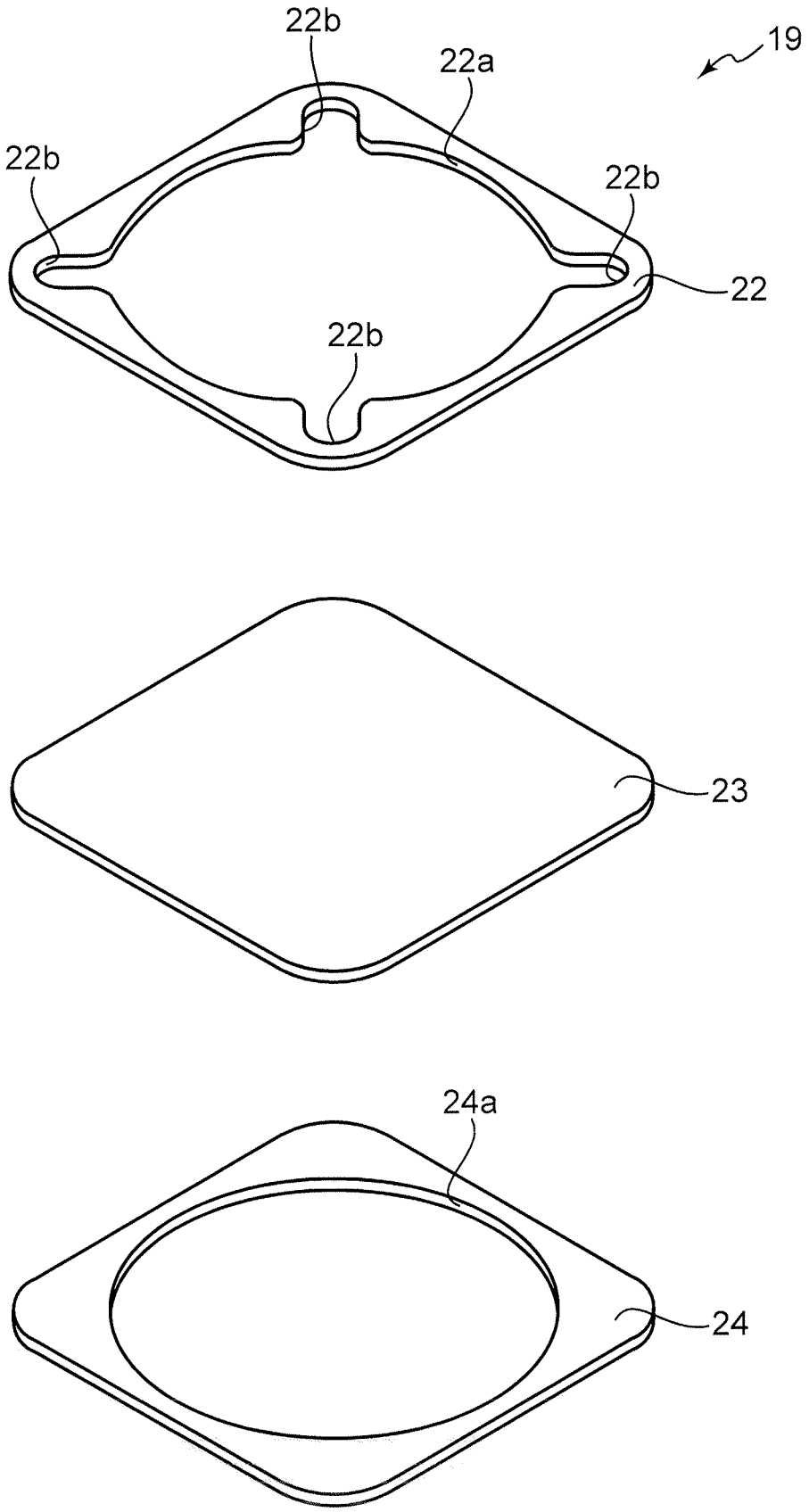
FIG. 8 is an exploded perspective view of a chamber section shown in FIG. 7.

With reference to FIGS. 3 and 8, the first metal layer piece 22 includes a through-opening 22*a* having a circular shape and passing through the first metal layer piece 22 in the stacking direction, and four expansion portions 22*b* each extending from the through-opening 22*a* in a radially outward direction thereof.

The through-opening 22*a* defines a movable area for the pump side diaphragm 9 in the second metal layer piece 23. Further, the piezoelectric element 4 is disposed in the through-opening 22*a* (see FIG. 3).

Figure 11:
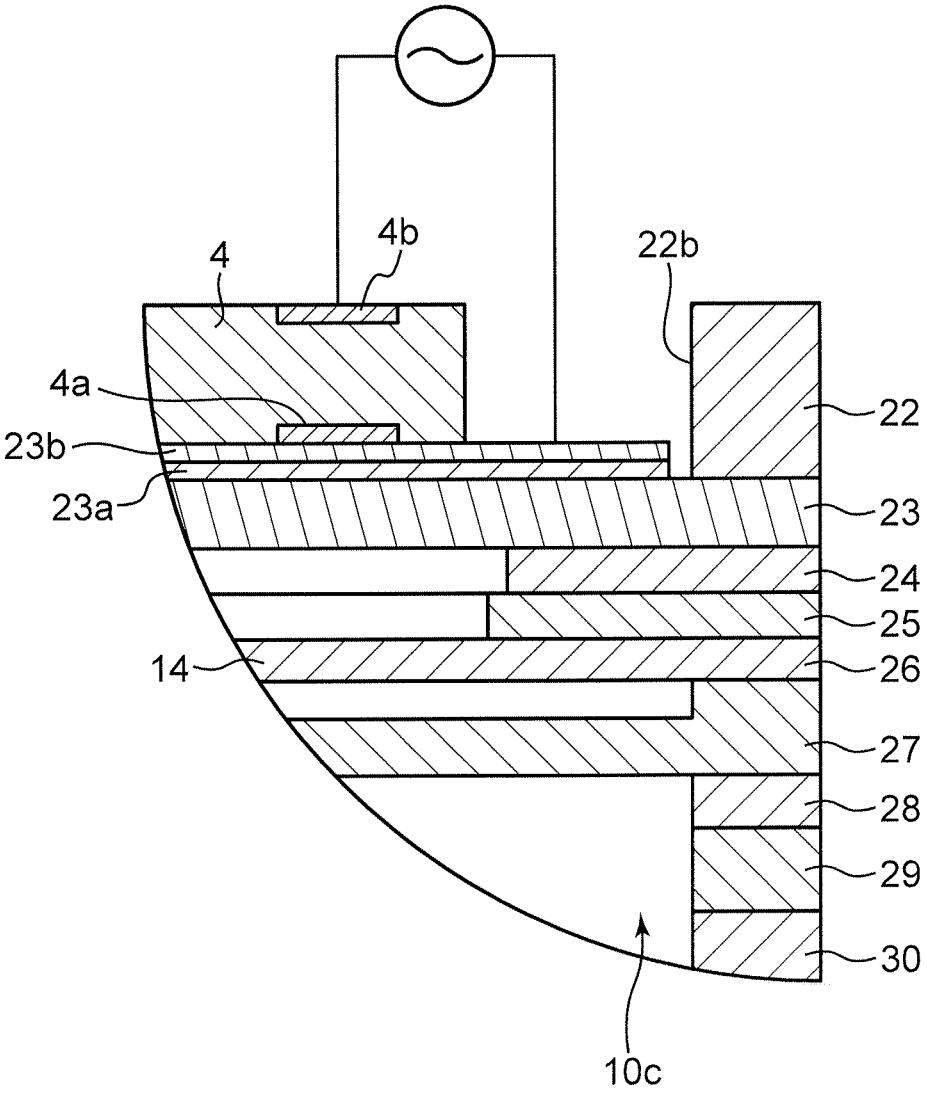
FIG. 11 is an enlarged sectional view showing part of FIG. 2.

The expansion portions 22*b* are provided for connecting the piezoelectric element 4 and a power source. Specifically, as shown in FIG. 11, the second metal layer piece 23 has a surface (a side surface opposite from the pump chamber S1) formed with a connected layer 23*b* via an insulating layer 23*a*. A first connection portion 4*a* disposed on the piezoelectric element 4 is electrically connected to the connected layer 23*b*, and a second connection portion 4*b* is disposed on a side surface of the piezoelectric element 4 opposite from the first connection portion 4*a*. The expansion portions 22*b* expose the connected layer 23*b* at lateral sides of the piezoelectric element 4. This makes it possible to connect one electrode of the power source (shown without a reference character) to the connected layer 23*b*, and the other electrode of the power source to the second connection portion 4*b*.

Again with reference to FIGS. 3 and 8, the second metal layer piece (pump side diaphragm metal layer piece) 23 includes the pump side diaphragm 9.

The third metal layer piece (pump chamber metal layer piece) 24 includes a through-opening (pump chamber opening) 24*a* defining the pump chamber S1.

Figure 9:
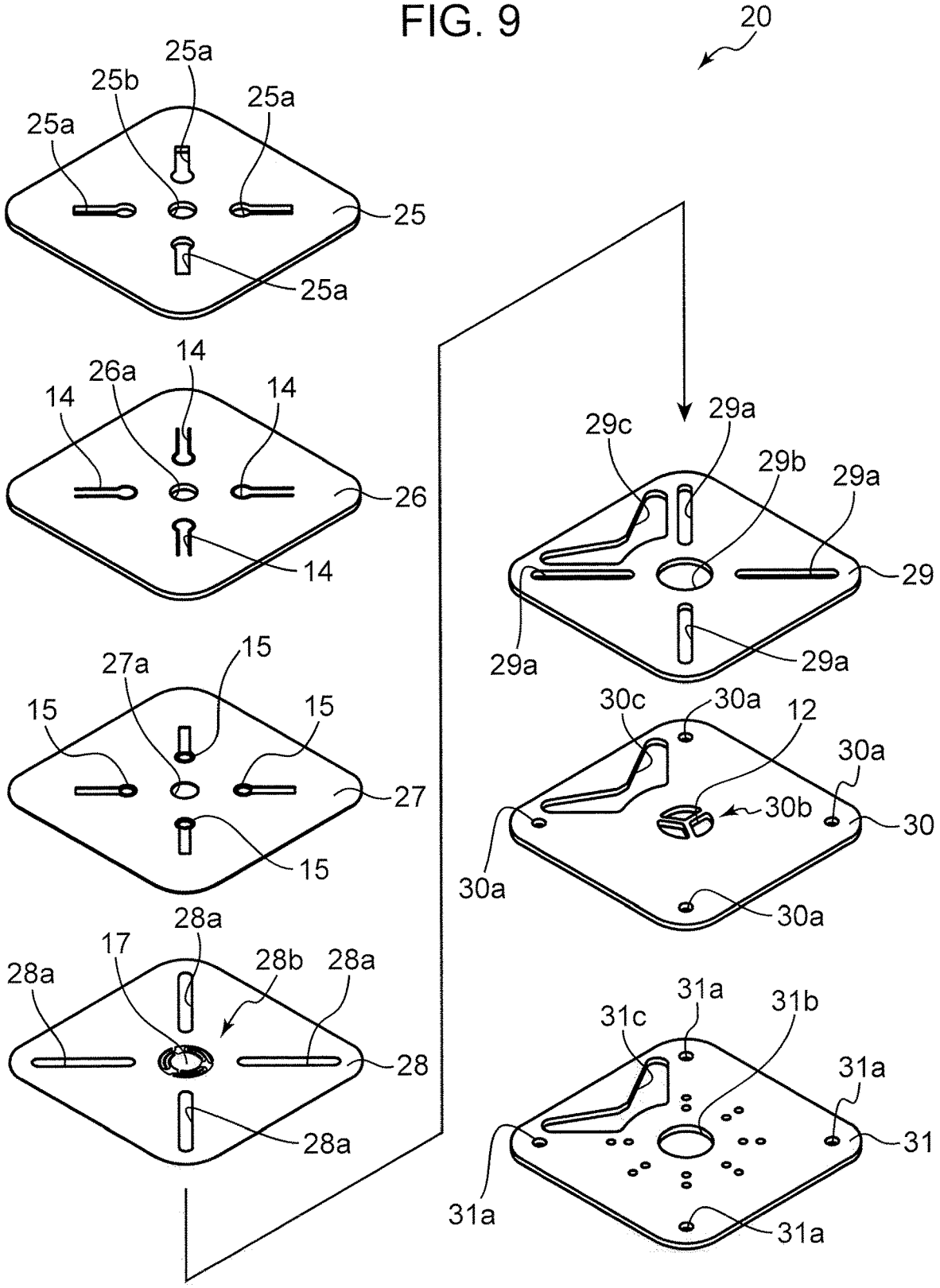
FIG. 9 is an exploded perspective view of an intermediate section shown in FIG. 7.

With reference to FIGS. 3 and 9, the fourth metal layer piece 25 includes four through-openings 25*a* each constituting part of the flow-in passage 13 and a though-opening 25*b* constituting part of the flow-out passage 16. Each through-opening 25*a* defines a space for allowing the flow-in valve 14 to resiliently deform toward the pump chamber.

The fifth metal layer piece 26 includes the above-mentioned four flow-in valves 14, and a through-opening 26*a* constituting part of the flow-out passage 16.

The sixth metal layer piece 27 includes a through-opening 27*a* constituting part of the flow-out passage 16. One side surface of the sixth metal layer piece 27 is formed with the above-mentioned four flow-in valve seats 15, and the other side surface of the sixth metal layer piece 27 is formed with the above-mentioned flow-out valve seat 18 (not shown in FIG. 9). Further, a through-opening (shown without a reference character) that constitutes part of the flow-in passage 13 is formed inside each of the flow-in valve seats 15 of the sixth metal layer piece 27.

The seventh metal layer piece 28 includes four through-openings 28*a* each constituting part of the flow-in passage 13, and a through-opening 28*b* constituting part of the flow-out passage 16. The above-mentioned flow-out valve 17 is disposed in the through-opening 28*b* of the seventh metal layer piece 28. The flow-out valve 17 includes a closure portion (shown without a reference character) for closing the flow-out passage 16, and an arm (shown without a reference character) connecting the closure portion and a portion of the seventh metal layer piece 28 other than the closure portion (has substantially the same shape as a flow-in valve 50A shown in FIG. 28).

The eighth metal layer piece 29 includes four through-openings 29*a* each constituting part of the connected portion 10*d* of the flow-in side connection passage 10, a through-opening 29*b* constituting part of the connected portion 11*a* of the flow-out side connection passage 11, and a through-opening 29*c* constituting part of the first extension portion 11*b* of the flow-out side connection passage 11.

The ninth metal layer piece 30 includes four through-openings 30*a* each constituting part of the first extension portion 10*c* of the flow-in side connection passage 10, a through-opening 30*b* constituting part of the connected portion 11*a* of the flow-out side connection passage 11, and a through-opening 30*c* constituting part of the first extension portion 11*b* of the flow-out side connection passage 11. The stopper 12 is disposed in the through-opening 30*b* of the ninth metal layer piece 30.

The tenth metal layer piece 31 includes four through-openings 31*a* each constituting part of the first extension portion 10*c* of the flow-in side connection passage 10, a through-opening 31*b* constituting part of the connected portion 11*a* of the flow-out side connection passage 11, and a through-opening 31*c* constituting part of the first extension portion 11*b* of the flow-out side connection passage 11. The tenth metal layer piece 31 corresponds to a valve seat metal layer piece including the valve seat 38 (not shown in FIG. 9) disposed on a peripheral edge of the through-opening 31*b*.

Figure 10:
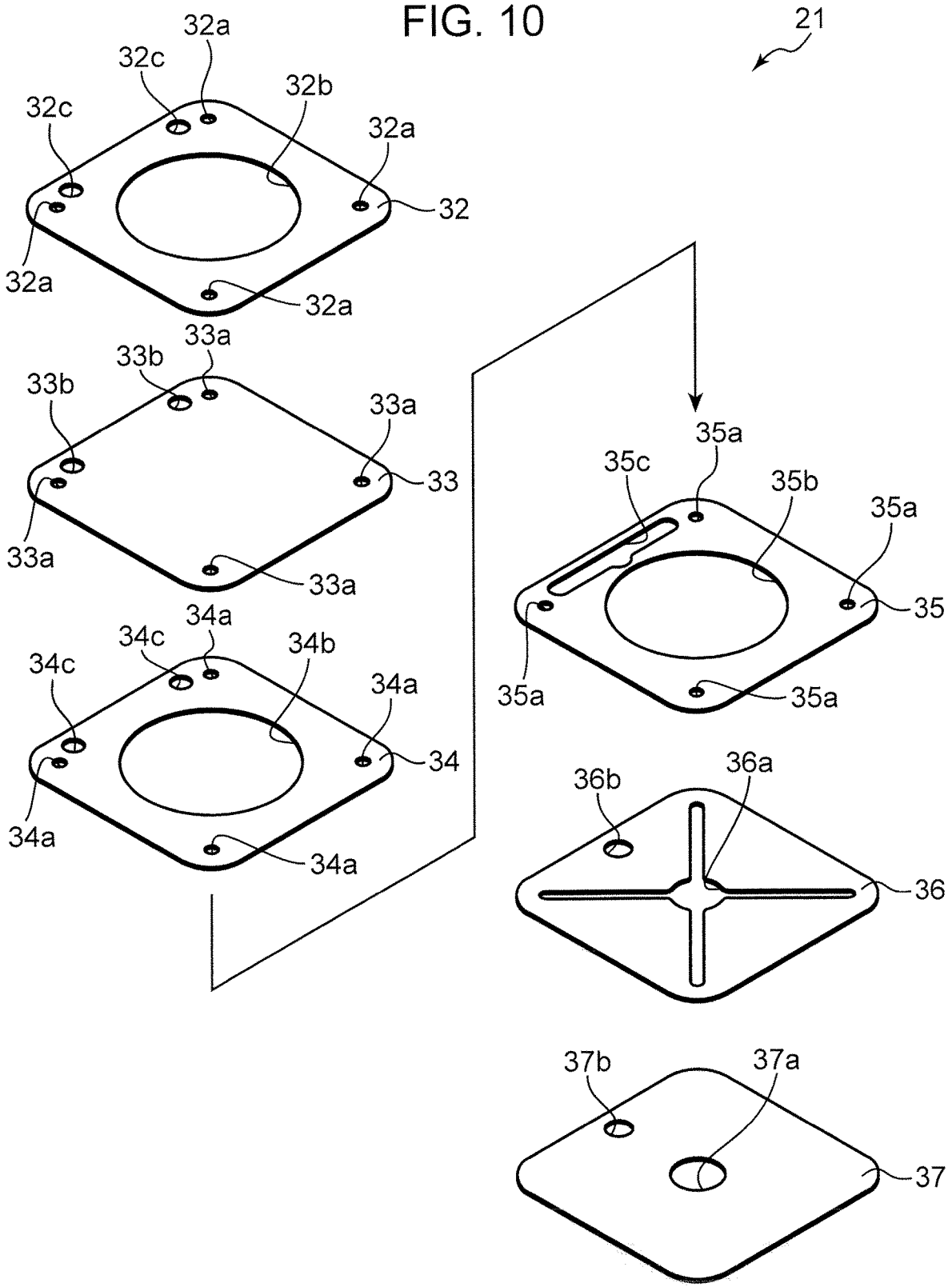
FIG. 10 is an exploded perspective view of a valve body section shown in FIG. 7.

With reference to FIGS. 3 and 10, the eleventh metal layer piece 32 includes four through-openings 32*a* each constituting part of the first extension portion 10*c* of the flow-in side connection passage 10, a through-opening 32*b* constituting part of the first extension portion 11*b* of the flow-out side connection passage 11, and two through-openings 32*c* each constituting part of the second extension portion 11*c* of the flow-out side connection passage 11. The eleventh metal layer piece 32 corresponds to a flow-out side defining metal layer piece including the through-opening 32*b* that defines a movable area for the valve side diaphragm 7 to the flow-out side connection passage 11 in the twelfth metal layer piece 33. Further, the eleventh metal layer piece 32 corresponds to a space creating metal layer piece including the through-opening (space creating opening) 32*b* that passes therethrough in the stacking direction for defining a space between the valve side diaphragm 7 and the valve seat 38. The four through-openings 32*a* lie outside the pump chamber S1 in the plan view (see FIG. 2).

The twelfth metal layer piece (valve side diaphragm metal layer piece) 33 includes the valve side diaphragm 7. Further, the twelfth metal layer piece 33 includes four through-openings 33*a* each constituting part of the first extension portion 10*c* of the flow-in side connection passage 10, and two through-openings 33*b* each constituting part of the second extension portion 11*c* of the flow-out side connection passage 11.

The thirteenth metal layer piece (flow-in side defining metal layer piece) 34 includes four through-openings 34*a* each constituting part of the first extension portion 10*c* of the flow-in side connection passage 10, a through-opening 34*b* constituting part of the flow-in portion 10*a* and the second extension portions 10*b* of the flow-in side connection passage 10, and two through-openings 34*c* each constituting part of the second extension portion 11*c* of the flow-out side connection passage 11. The through-opening 34*b* corresponds to a flow-in side defining opening that defines a movable area for the valve side diaphragm 7 to the flow-in side connection passage 10 in the twelfth metal layer piece 33.

The fourteenth metal layer piece 35 includes four through-openings 35*a* each constituting part of the first extension portion 10*c* of the flow-in side connection passage 10, a through-opening 35*b* constituting part of the flow-in portion 10*a* and the second extension portions 10*b* of the flow-in side connection passage 10, and a through-opening 35*c* constituting part of the flow-out portion 11*d* of the flow-out side connection passage 11.

The fifteenth metal layer piece 36 includes a through-opening 36*a* constituting part of the flow-in portion 10*a* of the flow-in side connection passage 10, and a through-opening 36*b* constituting part of the flow-out portion 11*d* of the flow-out side connection passage 11.

The sixteenth metal layer piece 37 includes a through-opening 37*a* constituting part of the flow-in portion 10*a* of the flow-in side connection passage 10, and a through-opening 37*b* constituting part of the flow-out portion 11*d* of the flow-out side connection passage 11.

It should be noted that FIGS. 8 to 10 show the first to sixteenth metal layer pieces 22 to 37 each in the form of a single metal plate, but alternatively, a plurality of metal plates may be stacked to be used for a metal layer piece with the front surface and the rear surface having the same shape. For example, FIG. 3 shows an example where the eight metal layer piece 28, the ninth metal layer piece 29, etc. are each in the form of a plurality of metal plates. Another metal layer piece may also be configured in the form of a plurality of metal plates. On the other hand, it is also possible to use a metal plate having a great thickness, but in this case, the surface roughness of the metal plate would be great, which would have a negative influence in the diffusion welding. Therefore, it is preferred to increase the thickness of a metal layer piece by using a plurality of thin metal plates as mentioned above.

With reference to FIGS. 2 and 3, the valve side diaphragm 7 lies inside the pump side diaphragm 9 in the plan view looking at the pump unit 1 in the stacking direction (along the central axis J) as mentioned above. In other words, the through-opening (flow-out side defining opening; see FIG. 10) 32*b* of the eleventh metal layer piece 32 and the through-opening (flow-in side defining opening; see FIG. 10) 34*b* of the thirteenth metal layer piece 34 lie inside the through-opening (pump chamber opening; see FIG. 8) 24*a* of the third metal layer piece 24 in the plan view. Therefore, the flow-in side connection passage 10 and the flow-out side connection passage 11 each include a portion lying inside the pump side diaphragm 9 (respective parts of the connected portion 10*d* of the flow-in side connection passage 10 and the connected portion 11*a* and the first extension portion 11*b* of the flow-out side connection passage 11; hereinafter, also referred to as "inner lying portion") in the plan view between the diaphragms 7 and 9.

Here, in the diffusion welding, it is necessary to apply a pressure to the stacked plurality of metal layer pieces in the stacking direction, but it is difficult to effectively transmit the pressure to portions of the metal layer pieces that overlap the pump side diaphragm 9 (pump chamber S1; space). Therefore, it is difficult to form the respective inner lying portions of the connection passages 10 and 11 by diffusion welding.

Figure 7:
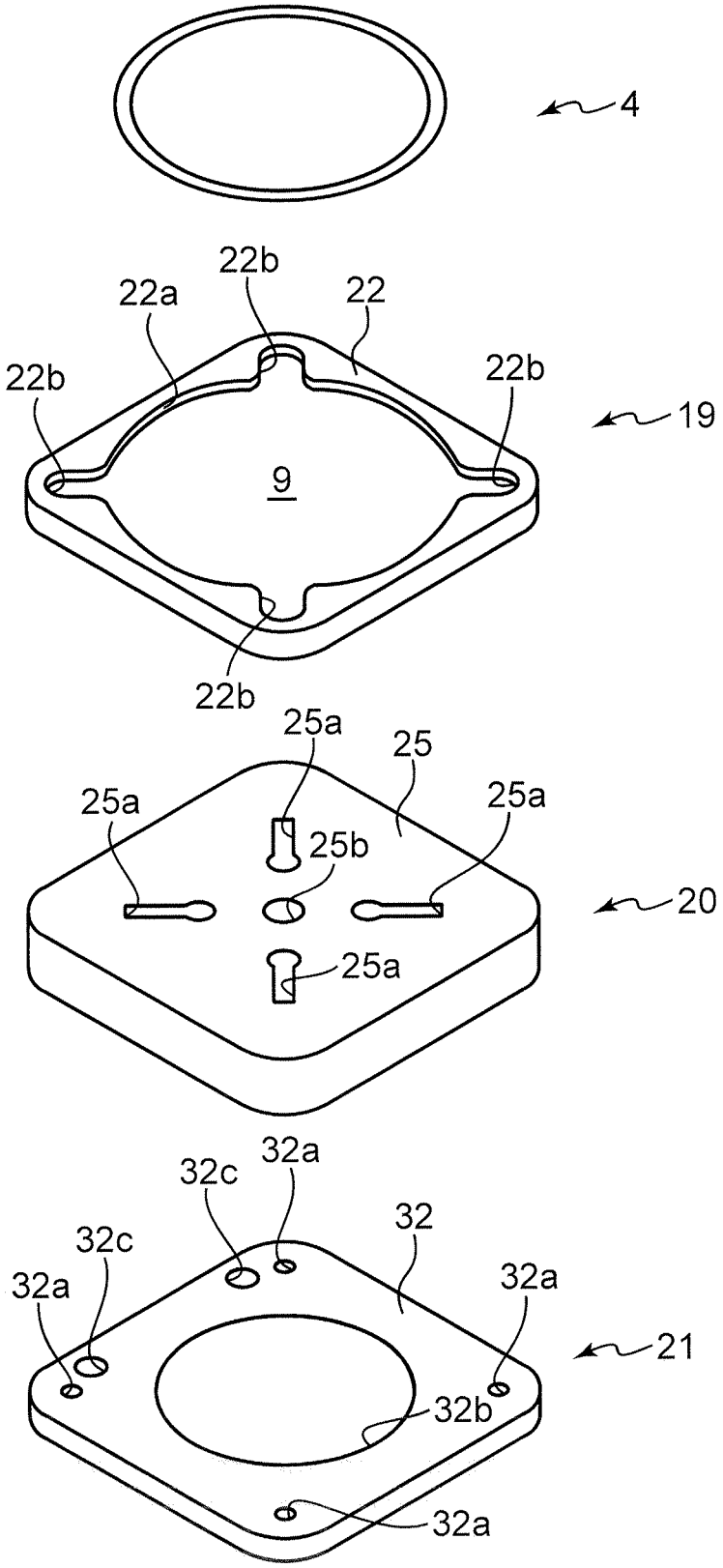
FIG. 7 is an exploded perspective view of the pump unit shown in FIG. 1.

Accordingly, as shown in FIGS. 3 and 7, the pump unit 1 is formed by separately manufacturing a chamber section 19 including the first to third metal layer pieces 22 to 24, a valve body section 21 including the eleventh to sixteenth metal layer pieces 32 to 37, and an intermediate section 20 lying between the chamber section 19 and the valve body section 21.

Hereinafter, a method for manufacturing the pump unit 1 will be described.

First, the metal layer pieces 22 to 37 shown in FIGS. 3 and 8 to 10 are prepared (preparation step).

Specifically, in the preparation step, between the eleventh metal layer piece 32 and the thirteenth metal layer piece 34 that define the movable area for the valve side diaphragm 7, the eleventh metal layer piece 32 is prepared as a proximate metal layer piece that is disposed closer to the pump chamber S (third metal layer piece 24), the eleventh metal layer piece 32 including no other opening than the plurality of through-openings (passage forming openings) 32*a*, 32*c* and the through-opening 32*b* in order to form the flow-in side connection passage 10 and the flow-out side connection passage 11, as shown in FIG. 10.

In addition, in the preparation step, the tenth metal layer piece (adjacent metal layer piece) 31 is prepared that includes the through-openings (communication openings) 31*a* each having a peripheral edge that can be brought into close contact with the peripheral edge of the through-opening (first passage forming opening) 32*a* among the plurality of through-openings 32*a*, 32*c*, as shown in FIG. 9.

Thereafter, the metal layer pieces 22 to 37 are joined to one another by diffusion welding (joining step).

Specifically, the joining step includes, as shown in FIG. 7, an intermediate joining step (first joining step) of joining, among the metal layer pieces 22 to 37, metal layer pieces that are included in the intermediate section 20 by diffusion welding, a chamber joining step of joining metal layer pieces that are included in the chamber section 19 by diffusion welding, a valve body joining step of joining metal layer pieces that are included in the valve body section 21 by diffusion welding, and an integral joining step (second joining step) of joining the chamber section 19, the valve body section 21, and the intermediate section 20 to one another.

In the intermediate joining step, as shown in FIGS. 3 and 9, the intermediate section 20 is formed by diffusion welding separately from the chamber section 19 and the valve body section 21. Therefore, it is possible to reliably form, by diffusion welding, respective portions of the connection passages 10, 11 that are defined in the intermediate section 20 and overlap the pump chamber S1 and the through-openings 32*b*, 34*b* in the plan view.

In the chamber joining step, as shown in FIGS. 3 and 8, the first to third metal layer pieces 22 to 24 are joined. Alternatively, the first to third metal layer pieces 22 to 24 may be joined to the chamber section 19 in the integral joining step described later, omitting the chamber joining step.

In the valve body joining step, the eleventh to sixteenth metal layer pieces 32 to 37 are joined by diffusion welding as shown in FIGS. 3 and 10.

It should be noted that the order of the intermediate joining step, the chamber joining step, and the valve body joining step is not limited to the above-described one.

Thereafter, in the integral joining step, the chamber section 19, the intermediate section 20, and the valve body section 21 are joined by diffusion welding.

Specifically, in the integral joining step, as shown in FIGS. 2, 3 and 7, diffusion welding is performed in a state in which the valve seat 38 and the through-opening (space creating opening) 32*b* of the eleventh metal layer piece (space creating metal layer piece) 32 overlap each other in the stacking direction and the eleventh metal layer piece 32 lies between the twelfth metal layer piece 33 and the tenth metal layer piece (valve seat metal layer piece) 31. Consequently, a space is defined between the valve seat 38 and the valve side diaphragm 7.

Further, in the integral joining step, the diffusion welding is performed in a state in which the through-opening (flow-out side defining opening) 32*b* of the eleventh metal layer piece 32 and the through-opening (flow-in side defining opening) 34*b* of the thirteenth metal layer piece 34 lie inside the through-opening (pump chamber opening) 24*a* of the third metal layer piece 24 in the plan view. Consequently, the valve side diaphragm 7 lies inside the pump side diaphragm 9 in the plan view, which allows the pump unit 1 to be made compact in a direction perpendicularly intersecting the stacking direction.

Further, in the integral joining step, the intermediate section 20 and the valve body section 21 are joined by diffusion welding in a state (the state shown in FIG. 2) in which the through-openings (passage forming openings) 32*a*, 32*c* of the eleventh metal layer piece 32 lie outside the through-opening 24*a* of the third metal layer piece 24 in the plan view. This makes it possible to transmit a pressure applied to the metal layer pieces 22 to 37 from a portion of the third metal layer piece 24 that lies outside the through-opening 24*a* to the other metal layer pieces in the integral joining step. Therefore, a portion around the through-openings 32*c* of the eleventh metal layer piece 32 can be joined to the tenth metal layer piece 31 by diffusion welding.

On the other hand, in the present embodiment, the expansion portions 22*b* formed in the first metal layer piece 22 overlap the through-openings 32*a* in the plan view as shown in FIG. 2, which makes it difficult to effectively transmit a pressure applied to the metal layer pieces 22 to 37 to respective portions around the through-openings 32*a* owing to the space within each expansion portion 22*b* in the integral joining step (the pressure is transmitted to the cross-hatched portion shown in FIG. 2).

Accordingly, in the integral joining step, the tenth metal layer piece 31 and the eleventh metal layer piece 32 are joined by diffusion welding in a state in which the peripheral edges of the through-openings 32*a* of the eleventh metal layer piece 32 and the peripheral edges of the through-openings 31*a* of the tenth metal layer piece 31 are in close contact with each other, as shown in FIGS. 3, 7 and 9. The close contact of the peripheral edges makes it possible to suppress leakage of fluid through the gaps between the through-openings 32*a* and the through-openings 31*a* even in the above-mentioned structure in which a pressure is difficult to be sufficiently transmitted.

After the integral diffusion welding is performed, a layer formation step is performed in which the connected layer 23*b* is formed on the side surface of the second metal layer piece 23 opposite from the pump chamber S1 via the insulating layer 23*a*. In the layer formation step, the insulating layer 23*a* and the connected layer 23*b* are formed in a region extending from a position inside the through-opening 22*a* to positions inside the expansion portions 22*b* of the first metal layer piece 22.

Thereafter, an attachment step is performed in which the piezoelectric element 4 is attached to the second metal layer piece 23 with the first connection portion 4*a* of the piezoelectric element 4 being electrically connected to the connected portion 23*b*.

The method for manufacturing the one pump unit 1 has been described with reference to FIGS. 7 to 10. Alternatively, the following method may be adopted to efficiently manufacture a plurality of pump units 1.

Figure 12:
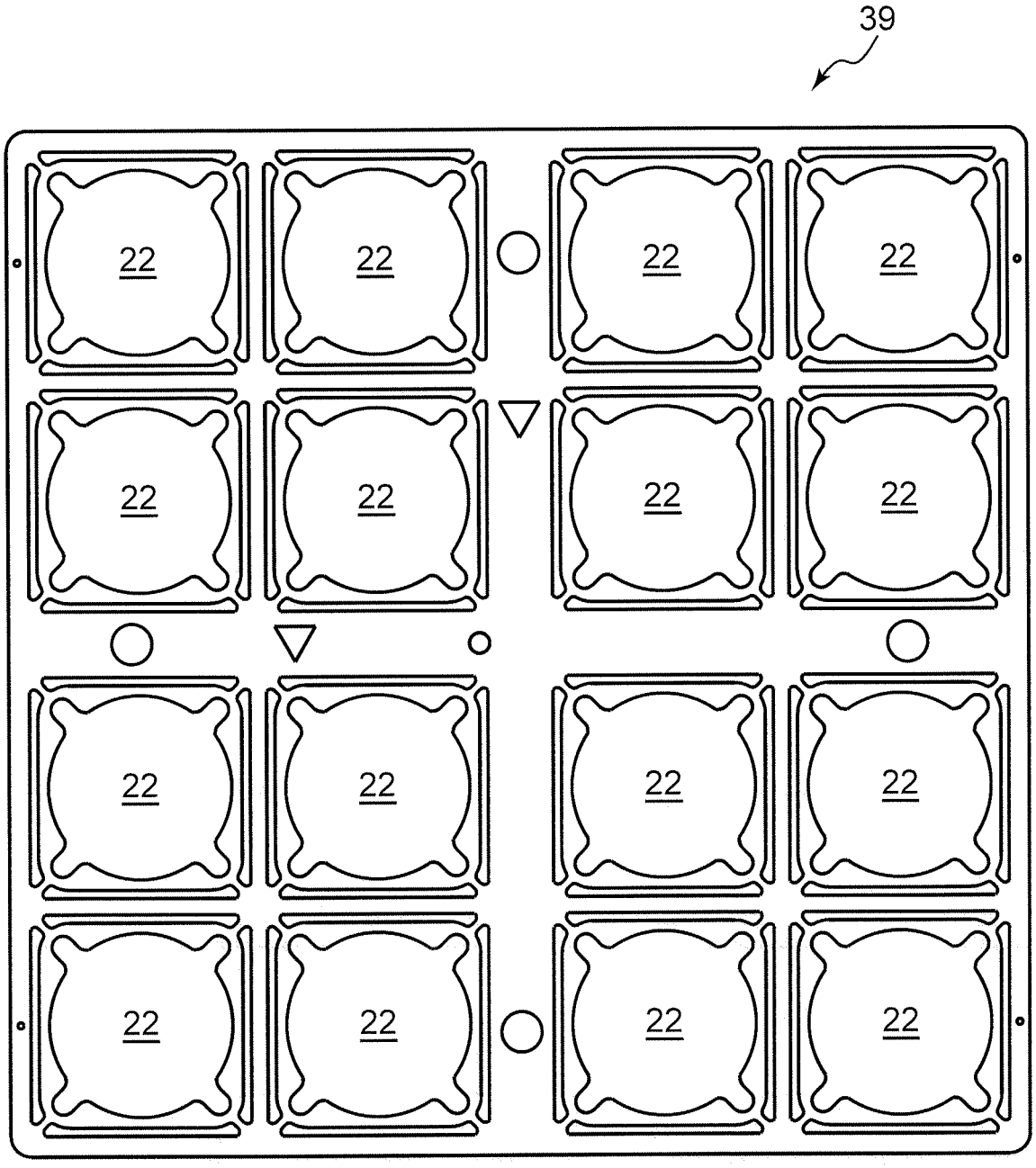
FIG. 12 is a plan view showing an example of a linkage metal plate that can be used for manufacturing the pump unit according to the first embodiment.

Specifically, in the preparation step, linkage metal plates 39 are prepared that each include a specified number of metal layer pieces of one of the metal layer pieces 22 to 37, the specified number of metal layer pieces being linked to one another, as shown in FIG. 12 (FIG. 12 shows only a linkage metal plate 39 including a plurality of first metal layer pieces 22 linked to one another).

Thereafter, in the joining step, the linkage metal plates 39 are joined to one another by diffusion welding. Consequently, a plurality of units each including the discharge mechanism 5 and the valve mechanism 3 are formed. The joining step may include the above-described intermediate joining step, chamber joining step, and valve body joining step.

After the joining step, a cutting step of cutting the linkage metal plates 39 into the units is performed.

Thereafter, in the attachment step, the piezoelectric element 4 is attached to the second metal layer piece 23. The attachment step may be performed before the cutting step.

In this manner, it is possible to manufacture a plurality of pump units 1 without performing the joining step a plurality of times. Consequently, it is possible to further improve the manufacturing efficiency of pump units 1.

As described above, the discharge mechanism 5 and the valve mechanism 3 are separately formed by joining the plurality of metal layer pieces 22 to 37 by diffusion welding, and the mechanisms 3 and 5 are secured to each other by diffusion welding. Therefore, it is possible to omit a step such as bonding for forming each of the discharge mechanism 5 and the valve mechanism 3, and eliminate the necessity to form a gasket in the joint between the discharge mechanism and the valve mechanism as in conventional cases.

Further, according to the first embodiment, the following advantageous effects can be provided.

The flow-out side connection passage 11 is open when the pressure in the flow-in side connection passage 10 is smaller than that when the valve side diaphragm 7 is deformed (i.e. when no abnormal pressure occurs in the flow-in side connection passage 10). Therefore, it is possible to prevent a pressure loss at the time of fluid discharge to thereby realize a stable fluid discharge.

The valve side diaphragm 7 lies inside the pump-side diaphragm 9 in the plan view. Therefore, it is possible to compactly configure the pump unit 1 in the direction perpendicularly intersecting the stacking direction. Consequently, it is possible to improve the flexibility of layout of the pump unit 1.

As shown in FIG. 7, among the plurality of metal layer pieces 22 to 37, the intermediate section 20 including the metal layer pieces that are stacked between the eleventh metal layer piece (proximity metal layer piece) 32 and the third metal layer piece (pump chamber metal layer piece) 24 are joined by diffusion welding, separately from the other metal layer pieces. This makes it possible to reliably form the inner lying portions in the intermediate section 20.

Further, as shown in FIG. 2, the through-openings (passage forming openings) 32*a*, 32*c* of the eleventh metal layer pieces 32 lie outside the through-opening (pump chamber opening) 24*a* of the second metal layer piece 24 in the plan view. Therefore, by joining all of the plurality of metal layer pieces 22 to 37 by diffusion welding, it is possible to apply a pressure to the respective peripheral portions of the through-openings 32*c* even via the second metal layer piece 24 including the through-opening 24*a*.

Therefore, it is possible to provide the pump unit 1 in which the flow-in side connection passage 10 and the flow-out side connection passage 11 are appropriately formed.

As shown in FIGS. 9 and 10, the metal layer pieces 31 and 32 are joined by diffusion welding in a state in which the peripheral edge of the through-opening (first passage forming opening) 32*a* of the eleventh metal layer piece 32 is in close contact with the peripheral edge of the through-opening (communication opening) 31*a* of the tenth metal layer piece (adjacent metal layer piece) 31. This makes it possible, even when another metal layer piece including an opening that overlaps the through-opening 32*a* is used, to suppress leakage of fluid through the joint between the through-openings 31*a*, 32*a*, owing to their close contact, as shown in FIG. 2.

Owing to the insulating layer 23*a* of the second metal layer piece 23, it is possible to prevent flow of electric current through fluid in the pump chamber S1. Therefore, the pump unit 1 can be applied to uses (for example, as a medical fluid injection pump for medical use) in which the flow of electric current through fluid is restricted.

In the above-described embodiment, the expansion portions 22*b* of the first metal layer piece 22 are respectively formed at the positions overlapping the through-openings 32*a* of the eleventh metal layer piece 32 in the plan view as shown in FIG. 2, but the expansion portions 22*b* are not limitedly disposed at these positions.

Figure 13:
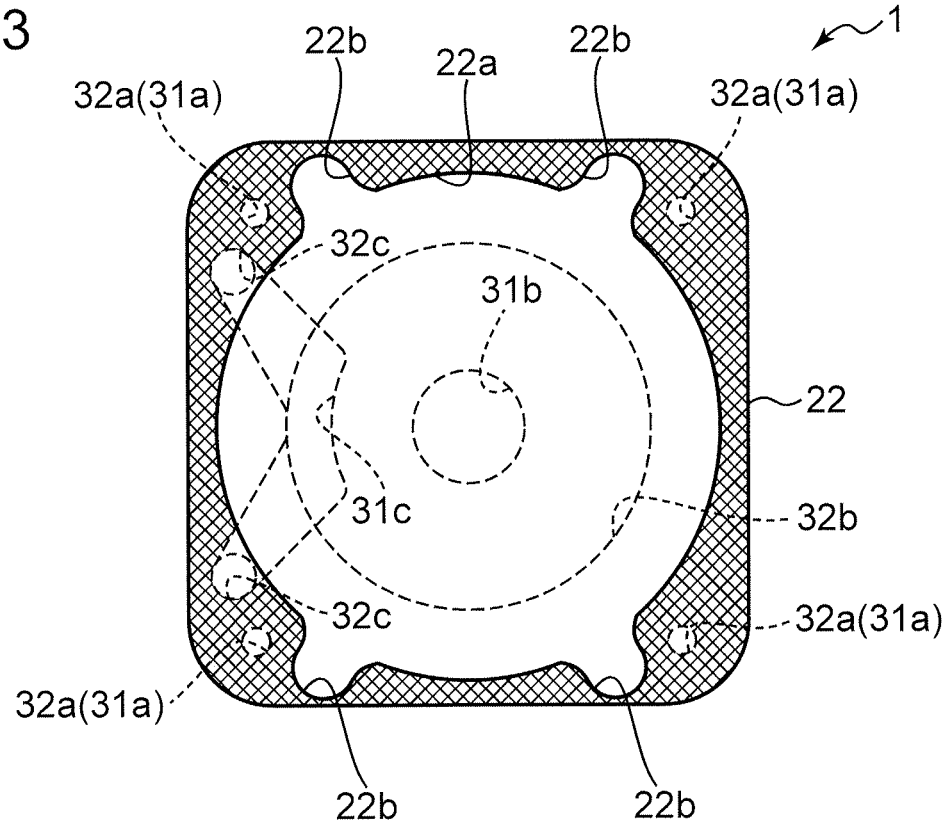
FIG. 13 shows a modification of the first embodiment, FIG. 13 corresponding to FIG. 2.

The expansion portion 22*b* may be formed at a position away from the through-opening 32*a* as shown in FIG. 13.

This will make it possible to reliably join the tenth metal layer piece 31 and the eleventh metal layer piece 32, including the peripheral portions of the through-openings 32*a* as shown by the cross hatched portion in FIG. 13, in the integral joining step.

Figure 14:
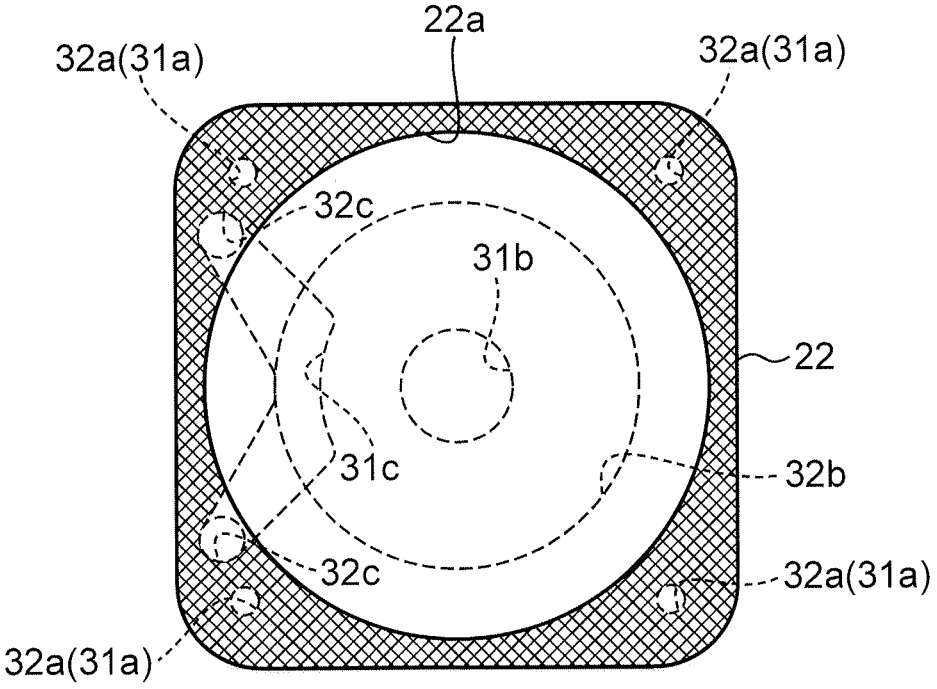
FIG. 14 shows a modification of the first embodiment, FIG. 14 corresponding to FIG. 2.

Further, the expansion portions 22*b* may be omitted as shown in FIG. 14 in a case where electric current is permitted to flow through fluid in the pump chamber S1 from the power source.

In this case, it is possible to electrically connect the first connection portion 4*a* (see FIG. 11) of the piezoelectric element 4 directly to the second metal layer piece 23. By electrically connecting one electrode of the power source to a part of the discharge mechanism 5 or the valve mechanism 3 and the other electrode of the power source to the second connection portion 4*b* of the piezoelectric element 4 in this state, the pump unit 1 can be driven.

Second Embodiment

First, the flow rate accuracy of the above-described pump unit 1 according to the first embodiment will be described.

Figure 15:
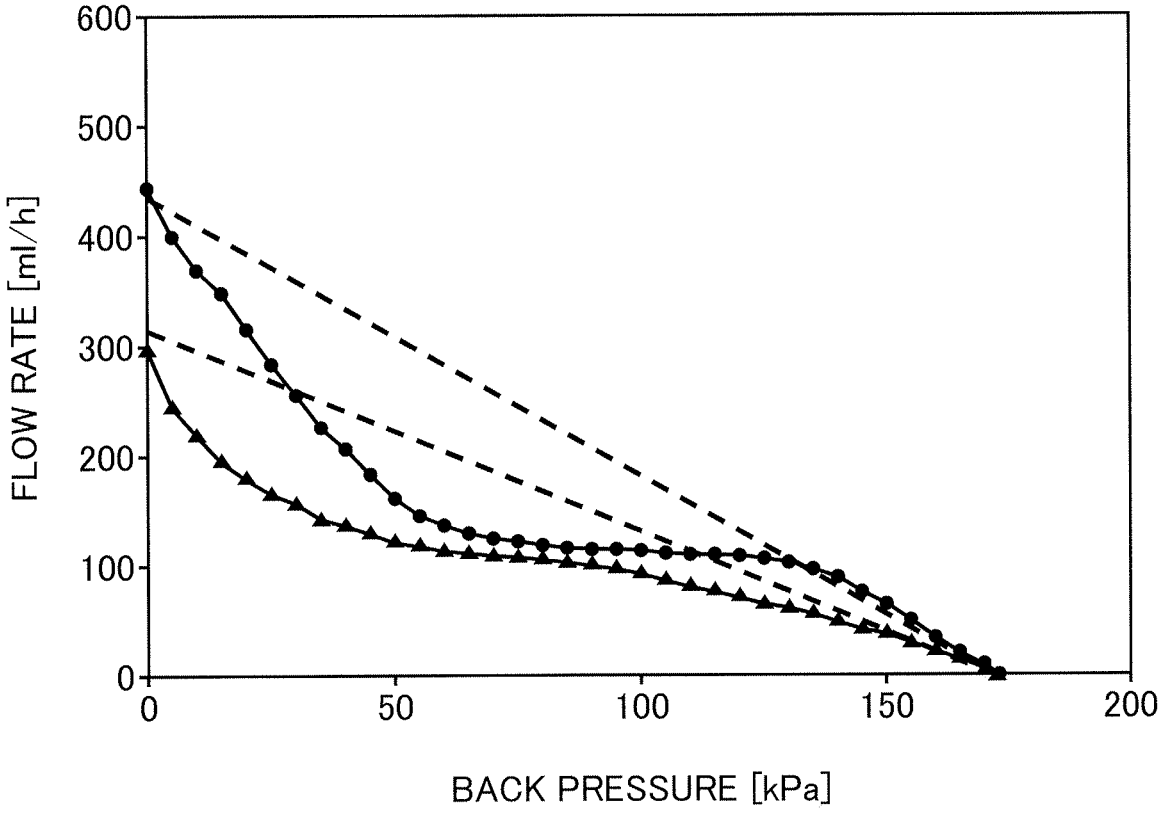
FIG. 15 is a graph showing a relation between flow rate and pressure (back pressure) of the pump unit according to the first embodiment.

FIG. 15 is a graph showing a relation between flow rate and pressure (back pressure) of the pump unit 1 according to the first embodiment. The pressure (back pressure) refers to the pressure on the downstream side of the flow-out valve 17. In FIG. 15, the line with dots represents a characteristic when a square wave at 100 Hz (with a maximum voltage of +240V and a minimum voltage of −60V) is used, and the upper dashed line represents an ideal characteristic for the structure of the pump unit 1 under the same condition. Further, in FIG. 15, the line with triangles represents a characteristic when a square wave of 50 Hz (with a maximum voltage of +240V and a minimum voltage of −60V) is used, and the lower dashed line represents an ideal characteristic for the structure of the pump unit 1 under the same condition.

As shown in FIG. 15, the flow rate characteristics of the pump unit 1 according to the first embodiment lie below the ideal characteristics in an intermediate pressure range (about 5 to about 100 Kpa), and are therefore, not linear.

This point will be discussed below.

In the first embodiment, the flow-out valve 17 is disposed at the center (on the central axis J) of the pump chamber S1 in the plan view (see FIG. 3), and the four flow-in valves 14 are disposed at axially symmetrical positions with respect to a straight line passing through the center of the pump chamber S in the plan view (see FIG. 9). Consequently, it is possible to cause fluid to flow to the flow-out valve 17 equally from the plurality of places around the flow-out valve 17. Therefore, it is possible to suppress stagnation of fluid in the pump chamber S1.

On the other hand, the flow-in valve 14 (see FIG. 3) is configured to close the flow-in passage 13 using the rigidity of the fifth metal layer piece 26. Therefore, there is a possibility that a small leakage may occur through the flow-in passage even when the flow-in valve 14 is closed. Because the four flow-in valves 14 are provided in the first embodiment, it is considered that the total amount of leakage of fluid through the flow-in valves 14 increases to reduce the flow rate accuracy. The reason why the flow rate characteristic is closer to the ideal characteristic when the pressure (back pressure) is great (when the flow-in valves 14 are biased in a closing direction) is that the closed state of the flow-in valves 14 is stable when the pressure is great.

Although details will be provided later, in a pump unit according to the second embodiment, the number of flow-in valves is reduced to two flow-in valves 50 (see FIG. 18) to thereby improve flow rate characteristic in relation to pressure (back pressure) while suppressing stagnation of fluid in a pump chamber S1.

Figure 16:
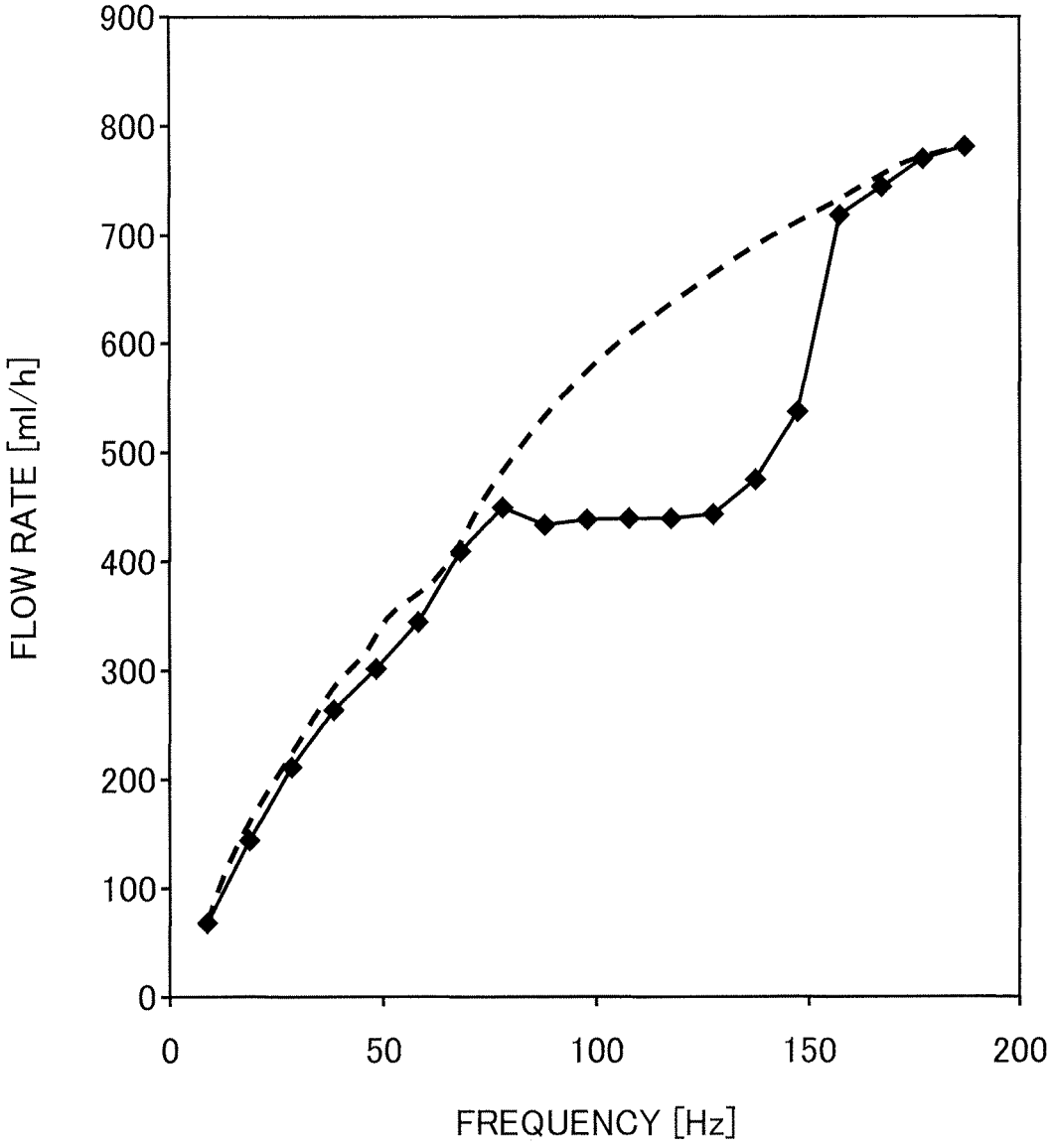
FIG. 16 is a graph showing a relation between flow rate and frequency of the pump unit according to the first embodiment.

In addition, FIG. 16 is a graph showing a relation between flow rate and frequency of the pump unit according to the first embodiment. In FIG. 16, the solid line represents flow rate when a square wave (with a maximum voltage of +240V and a minimum voltage of −60V) is used for the pump unit 1 according to the first embodiment. In FIG. 16, the dashed line represents an ideal characteristic for the structure of the pump unit under the same condition.

As shown in FIG. 16, the flow rate characteristic of the pump unit 1 according to the first embodiment lies below the ideal characteristic in a range from about 90 to 150 Hz, and is therefore, not linear.

Figure 22:
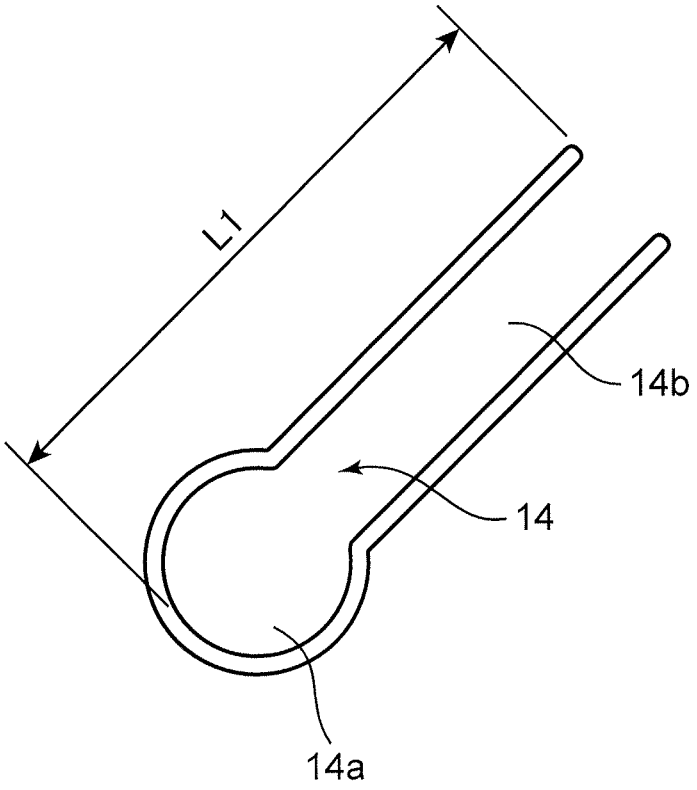
FIG. 22 is a plan view showing a flow-in valve in the first embodiment.

The reason is considered to be that the full length L1 of the flow-valve 14 is long, i.e. the spring constant is small, in the first embodiment, as shown in FIG. 22. Specifically, the flow-in valve 14 includes a closure portion 14*a* for closing the flow-in passage 13, and an arm 14*b* supporting the closure portion 14*a* in such a way as to allow the closure portion 14*a* to move between a position to close the flow-in passage 13 and a position to open the flow-in passage 13. In the flow-in valve 14, the arm 14*b* is longer than the closure portion 14*a*, and therefore, the spring constant of the arm 14*b* is relatively small. Therefore, it is difficult to cause the closure portion 14*a* to follow the pump side diaphragm 9 when the frequency of the pump side diaphragm 9 is relatively high.

Although details will be provided later, in the pump unit according to the second embodiment, the above-mentioned flow rate characteristic in relation to frequency is improved by increasing the spring constant, i.e., in an example shown in FIG. 23, configuring the flow-in valve 50 to have a full length L2 shorter than the full length L1 of the flow-in valve 14.

Figure 17:
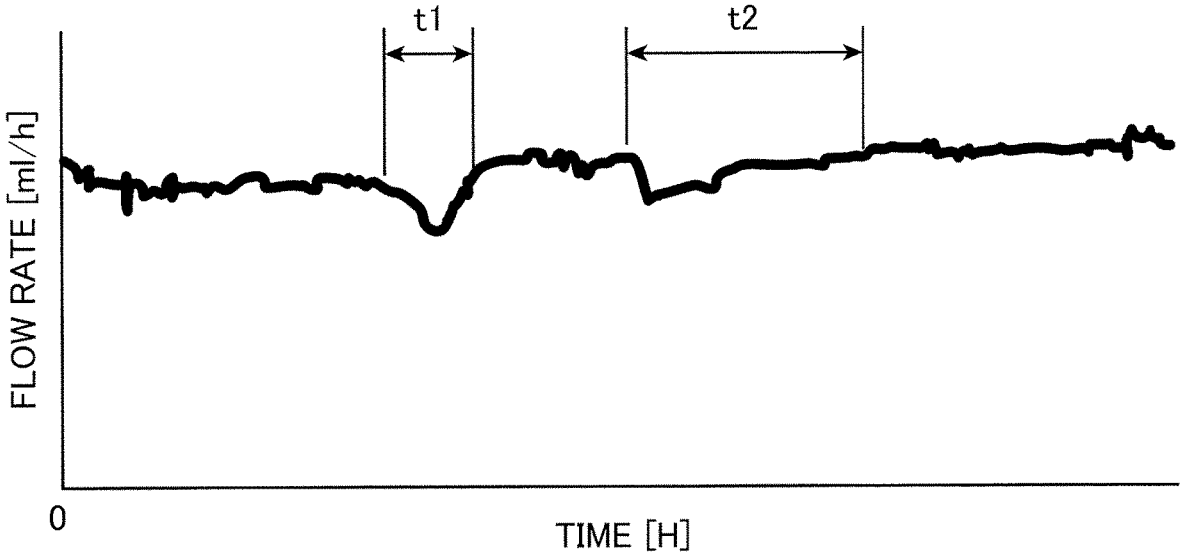
FIG. 17 is a graph showing a relation between time and flow rate for explaining air escape from the pump unit according to the first embodiment.

FIG. 17 shows flow rate fluctuations when the pump unit 1 according to the first embodiment is purposely caused to suck air while the pump unit 1 is discharging fluid. In FIG. 17, air is sucked at the beginning of a period t1 and at the beginning of a period t2. When air is sucked, the air expands and contracts in accordance with vibrations of the pump-side diaphragm 9, which makes it difficult to discharge an appropriate amount of fluid consistent with volume fluctuations in the pump chamber S1. This phenomenon appears as a decrease in the flow rate in the periods t1 and t2. Because the flow rate is restored at the end of each of the periods t1, t2, it is considered that the air has been caused to flow out of the pump unit 1. Here, the period t1 is about an hour, and the period t2 is about three hours.

Figure 24:
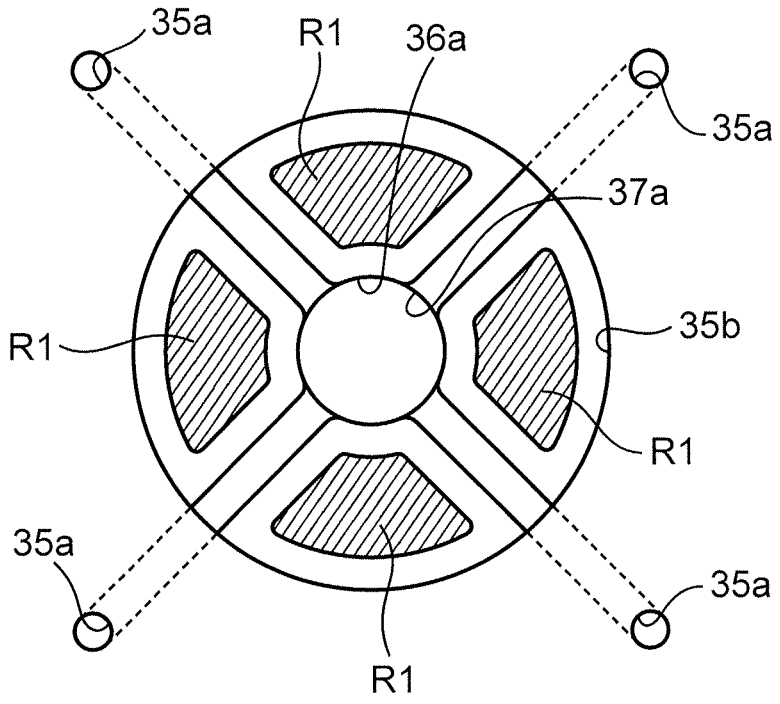
FIG. 24 is a plan view showing fourteenth to sixteenth metal layer pieces in the valve body section in the first embodiment as seen from the valve side diaphragm.

The reason why a long time is required for the air escape, is considered to be that, as shown in FIG. 24, the sectional area of the fluid passage extending from the through-opening 37*a* (flow-in portion 10*a*: see FIG. 3) to each through-opening 35*a* (first extension portion 10*c*: see FIG. 3) abruptly changes to make the flow rate distribution in the passage uneven.

Specifically, in the first embodiment, the through-opening 35*b* lies above the through-opening 37*a*, the through-opening 35*b* being greater than the through-opening 37*a* and defining the movable area for the valve side diaphragm 7. Therefore, in the through-opening 35*b*, the flow rate of fluid is highest along straight lines each connecting the through-opening 37*a* and the through-opening 35*a*, and a flow rate is low in regions R1 defined between adjacent straight lines, the regions R1 being indicated by hatching. This is considered to be a cause of stagnation of air in the regions R1.

Figure 25:
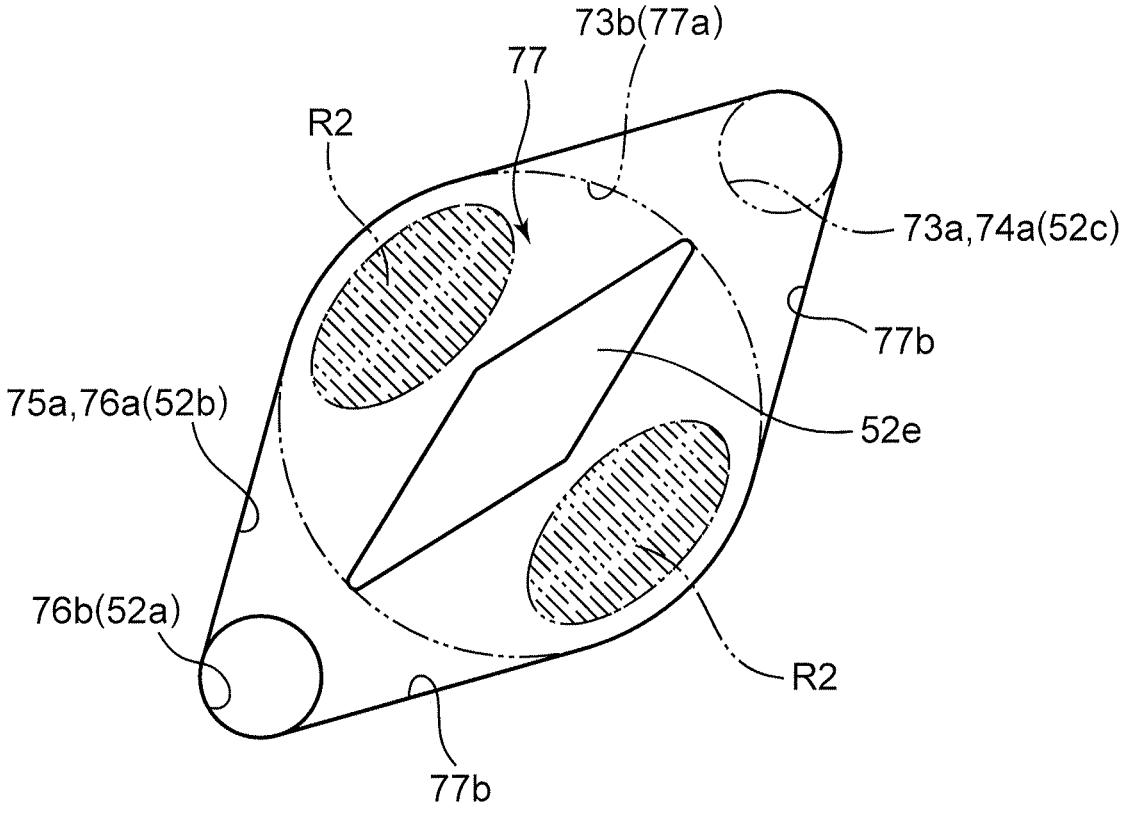
FIG. 25 is a plan view showing fourteenth and fifteenth metal layer pieces in the valve body section in the second embodiment as seen from a valve side diaphragm.

Although details will be provided later, in the pump unit according to the second embodiment, the flow rate characteristic is improved by reducing the variation in the sectional area of fluid in a region between a through-opening 76*b* for causing the fluid to flow into a through-opening 73*b* that defines a movable area for a valve side diaphragm 47 and through-openings 73*a*, 74*a* for causing the fluid to flow out through the through-opening 73*b*, as shown in FIG. 25.

Hereinafter, the pump unit according to the second embodiment will be described with reference to FIGS. 18 to 20. A piezoelectric element 4 and a chamber section 19 in the pump unit according to the second embodiment have the same configurations as those of the first embodiment, and are therefore shown only in FIG. 21, and descriptions thereof will be omitted.

Figure 18:
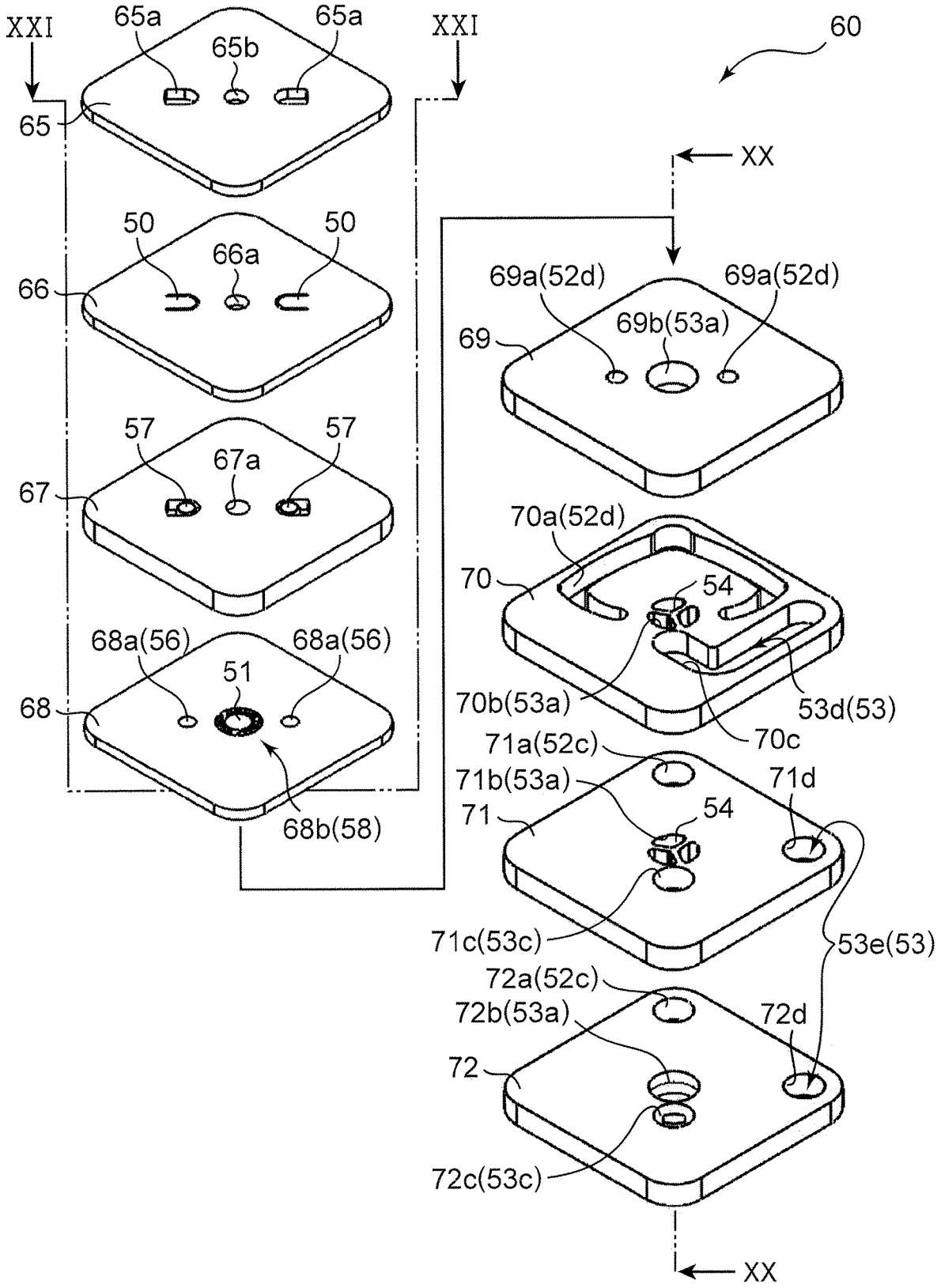
FIG. 18 is an exploded perspective view of an intermediate section of a pump unit according to a second embodiment of the present invention.

FIG. 18 is an exploded perspective view of an intermediate section 60 of the pump unit according to the second embodiment. FIG. 19 is an exploded perspective view of a valve body section 61 of the pump unit according to the second embodiment. FIG. 20 shows a sectional view taken along the line XX in FIG. 18 and a sectional view taken along the line XX in FIG. 19 together. FIG. 21 is a sectional view taken along the line XXI in FIG. 18.

Figure 20:
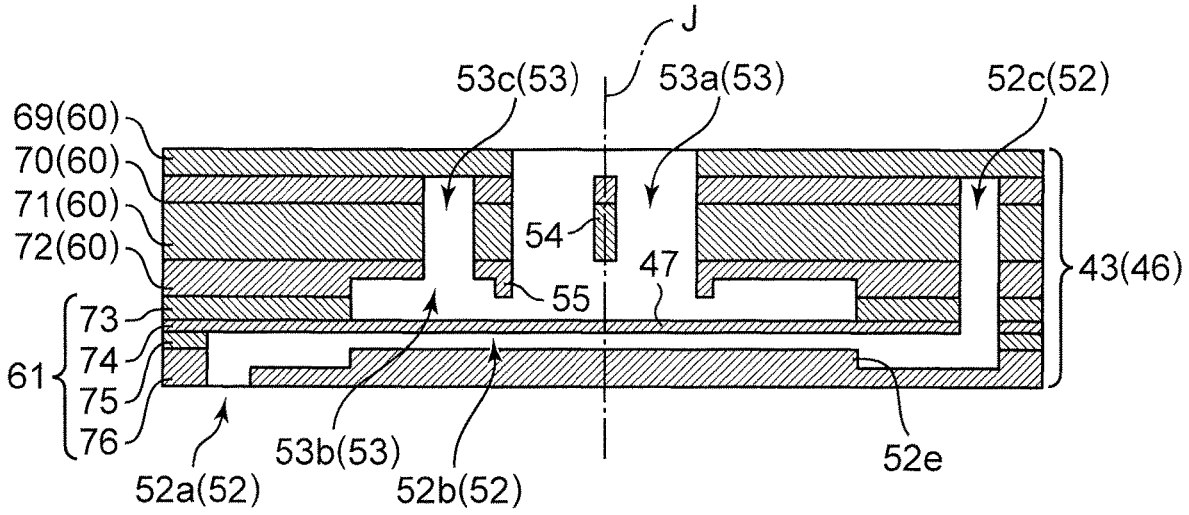
FIG. 20 shows a sectional view taken along the line XX in FIG. 18 and a sectional view taken along the line XX in FIG. 19 together.
Figure 21:
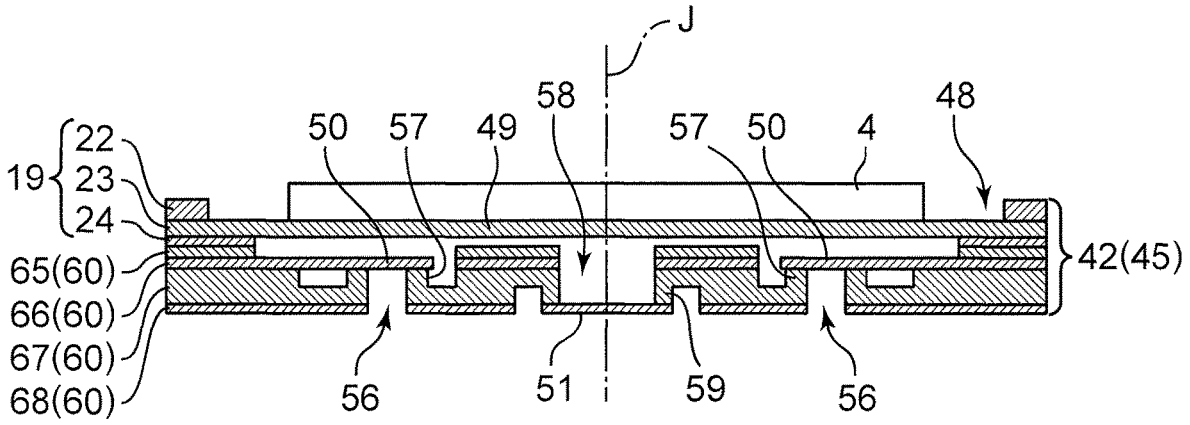
FIG. 21 is a sectional view taken along the line XXI in FIG. 18 with a chamber section additionally shown.

First, with reference to FIGS. 20 and 21, the pump unit includes a pump 42 for discharging fluid, and a valve mechanism 43 for restricting flowing out of fluid through the pump 42 when the pressure of fluid on the upstream side of the pump 42 increases.

The pump 42 includes the piezoelectric element 4 and a discharge mechanism 45 for discharging fluid according to operation of the piezoelectric element 4.

The discharge mechanism 45 includes a pump body 48, a pump side diaphragm 49 defining a pump chamber S1 in cooperation with the pump body 48, two flow-in valves 50 that are respectively disposed in two flow-in passages 56 formed in the pump body 48 and connecting with the pump chamber S1, and a flow-out valve 51 that is disposed in a flow-out passage 58 formed in the pump body 48 and connecting with the pump chamber S1.

The pump chamber S1 is a space (not shown) having a substantially circular shape in plan view. The flow-out passage 58 is connected to a center (on a central axis J) of the pump chamber S1 in the plan view. The two flow-in passages 56 are disposed at axially symmetrical positions with respect to a straight line passing through the central axis J of the pump chamber S1 (disposed at 180 degrees apart from each other, centered on the central axis J).

In accordance with the above-mentioned configurations, the flow-out valve 51 is disposed at the center of the pump chamber S1 in the plan view, and no other flow-in valve is provided other than the two flow-in valves 50 that are disposed at axially symmetrical positions with respect to the straight line passing through the central axis J of the pump chamber S1.

Consequently, it is possible to cause fluid to flow to the flow-out valve 51 equally from the plurality of places around the flow-out valve 51. Therefore, it is possible to suppress stagnation of fluid in the pump chamber S1. In addition, because the number of flow-in valves 50 is limited to two, it is possible to minimize the total amount of leakage through the flow-in valves 50 in a closed state.

Further, the flow-in passages 56 and the flow-out passage 58 lie inside the pump chamber S1 in the plan view looking at the pump unit along the central axis J (in a stacking direction of metal layer pieces 65 to 76 described later).

The pump body 48 includes flow-in valve seats 57 for closing the flow-in passages 56 in cooperation with the flow-in valves 50, and a flow-out valve seat 59 for closing the flow-out passage 58 in cooperation with the flow-out valve 51.

When the pressure on the upstream side of the flow-in valve 50 is equal to or smaller than the pressure in the pump chamber S1, the flow-in valve 50 comes into close contact with the flow-in valve seat 57 to close the flow-in passage 56. On the other hand, when the pressure on the upstream side of the flow-in valve 50 is greater than the pressure in the pump chamber S1, the flow-in valve 50 resiliently deforms to separate from the flow-in valve seat 57 to open the flow-in passage 56.

When the pressure in the pump chamber S1 is equal to or smaller than the pressure on the downstream side of the flow-out valve 51, the flow-out valve 51 comes into close contact with the flow-out valve seat 59 to close the flow-out passage 58. On the other hand, when the pressure in the pump chamber S1 is greater than the pressure on the downstream side of the flow-out valve 51, the flow-out valve 51 resiliently deforms to separate from the flow-out valve seat 59 to open the flow-out passage 58.

Figure 23:
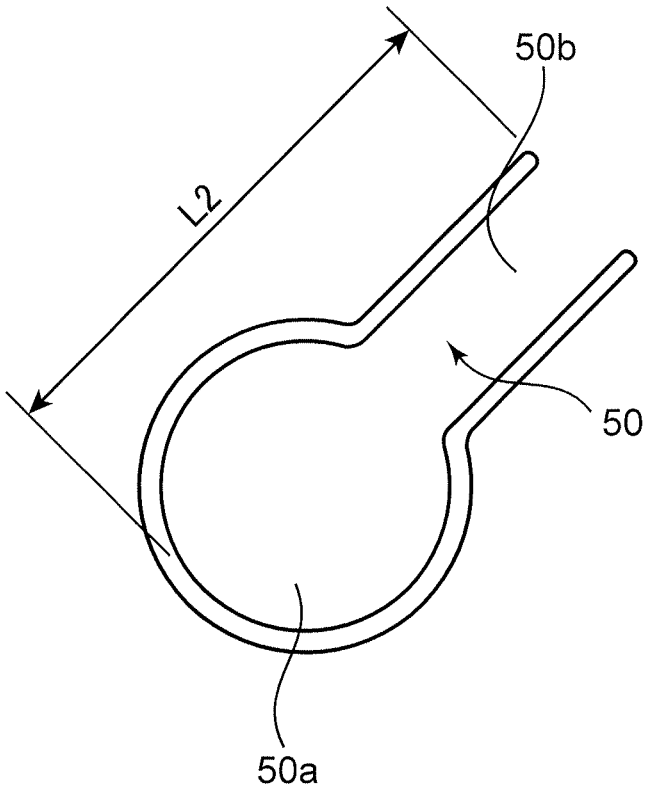
FIG. 23 is a plan view showing a flow-in valve in the second embodiment.

The flow-out valve 51 includes a closure portion 50*a* for closing the flow-in passage 56 (able to come into contact with the flow-in valve seat 57), and an arm 50*b* supporting the closure portion 50*a* in such a way as to allow the closure portion 14*a* to move between a position to close the flow-in passage 56 and a position to open the flow-in passage 56, as shown in FIG. 23. In the flow-out valve 51, the length L2 from a proximal end of the arm 50*b* to a distal end of the closure portion 50*a* is shorter than the length L1 from a proximal end of the arm 14*b* to a distal end of the closure portion 14*a* in the flow-out valve 14 of the first embodiment as shown in FIG. 22. Here, the closure portion 14*a* of the first embodiment and the closure portion 50*a* of the second embodiment have substantially the same size, and therefore, the difference between the length L1 and the length L2 substantially corresponds to the difference between the length of the arm 14*b* and the length of the arm 50*b*.

This configuration makes it possible, as compared to the flow-out valve 14 of the first embodiment, to increase the spring constant of the flow-out valve 51 (in particular, the arm 50*b*). Consequently, it is possible to improve the followability of the closure portion 50*a* when the frequency of the pump side diaphragm 49 increases.

The valve mechanism 43 includes a valve mechanism body 46 having a flow-in side connection passage 52 connecting with the flow-in passages 56 of the pump 42 and a flow-out side connection passage 53 connecting with the flow-out passage 58 of the pump 42, and the valve side diaphragm 47 disposed in the valve mechanism body 46 and dividing the flow-in side connection passage 52 from the flow-out side connection passage 53.

The valve side diaphragm 47 is disposed concentrically with the pump side diaphragm 49, and disposed inside the pump chamber S1 in the plan view (not shown). Further, the valve side diaphragm 47 is disposed in parallel to the pump side diaphragm 49. Each of the flow-in passages 56 and the flow-out passage 58 of the pump 42 is disposed between the diaphragms 47 and 49.

The flow-in side connection passage 52 extends from the flow-in passages 56 of the pump 42 to a position on the opposite side of the valve side diaphragm 47 from the pump 42 while bypassing the valve side diaphragm 47, and is open at an end surface of the valve mechanism body 46 on the opposite side from the pump 42.

Specifically, the flow-in side connection passage 52 includes a connected portion 52*d* (see eighth and ninth metal layer pieces 69, 70 in FIG. 18) connecting with both of the two flow-in passages 56 of the pump body 48 and configured to merge the passages 56, a first extension portion 52*c* extending from an end of the connected portion 52*d* that lies furthest from the central axis J on the connected portion 52*d* (a corner of the metal layer piece 70 shown in FIG. 18) and extending in parallel to the central axis J, a second extension portion 52*b* extending from the first extension portion 52*c* in a direction perpendicularly intersecting the central axis J, and a flow-in portion 52*a* extending from an end of the second extension portion 52 in parallel to the central axis J. The first extension portion 52*c* and the flow-in portion 52*a* are disposed at diagonally opposite positions of each of the metal layer pieces 73 to 76 shown in FIG. 19. As shown in FIG. 20, fluid caused to flow in through the flow-in portion 52*a* flows in the direction perpendicularly intersecting the central axis J through the second extension portion 52*b* and in the direction parallel to the central axis J through the first extension portion 52*c* to be then branched into two flows by the connected portion 52*d* (see FIG. 18) to be guided to the two flow-in passages 56 of the pump 42.

Here, in the flow-in side connection passage 52, part of the connected portion 52*d*, the entirety of the first extension portion 52*c*, part of the second extension portion 52*b*, and the entirety of the flow-in portion 52*a* lie outside the pump chamber S1 in the plan view, and the other part lies inside the pump chamber S1 in the plan view.

On the other hand, the flow-out side connection passage 53, as shown in FIG. 20, extends from the flow-out passage 56 of the pump 42 toward the valve side diaphragm 47, then extends along a surface of the valve side diaphragm 47 in a direction away from the central axis J, then returns toward the pump side diaphragm 49 while extending in parallel to the central axis J, then extends in the direction perpendicularly intersecting the central axis, and passes by the valve side diaphragm 47 to open at an end surface of the valve mechanism body 46 opposite from the pump 42.

Specifically, the flow-out side connection passage 53 includes a connected portion 53*a* connecting with the flow-out passage 58 of the pump body 48, a first extension portion 53*b* extending from an end of the connected portion 53*a* that lies closer to the valve side diaphragm 47 in the direction away from the central axis J, a second extension portion 53*c* extending from an end of the first extension portion 53*b* that lies farther from the central axis J in parallel to the central axis J toward the pump side diaphragm 49, a third extension portion 53*d* (see the metal layer piece 70 shown in FIG. 18) extending from an end of the second extension portion 53*c* that lies closer to the pump side diaphragm 49 in the direction perpendicularly intersecting the central axis J, and a flow-out portion 53*e* (see the metal layer pieces 71 and 72 shown in FIG. 18) extending from an end of the third extension portion 53*d* that lies farther from the central axis J in parallel to the central axis J. Fluid caused to flow out of the pump chamber S1 to the connected portion 53*a* is guided to a side of the valve side diaphragm 47 through the extension portions 53*b* to 53*d* to be caused to flow out through the flow-out portion 53*e*. In addition, in the connected portion 53*a*, a stopper 54 is provided for holding the flow-out valve 51 at a predetermined open position when the flow-out valve 51 is open.

Here, in the flow-out side connection passage 53, part of the third extension portion 53*d* and the entirety of the flow-out portion 53*e* lie outside the pump chamber S1 in the plan view, and the other part lies inside the pump chamber S1 in the plan view.

The valve side diaphragm 47 functions as a wall that defines part of the flow-in side connection passage 52 (part of the flow-in portion 52*a* and the second extension portion 52*b*), and also functions as a wall that defines part of the flow-out side connection passage 53 (part of the connected portion 53*a* and the first extension portion 53*b*).

Further, the valve mechanism body 46 includes a valve seat 55 operable to come into contact with the valve side diaphragm 47 to thereby restrict flow of fluid through the flow-out side connection passage 53.

The valve side diaphragm 47 is spaced from the valve seat 55. Further, the valve side diaphragm 47 has an elasticity to resiliently deform to come into contact with the valve seat 55 when the pressure in the flow-in side connection passage 52 is equal to or greater than a predetermined reference pressure that is greater than the pressure in the flow-out side connection passage 53.

Therefore, fluid is permitted to flow through the flow-out side connection passage 53 when the pressure in the flow-in side connection passage 52 is smaller than the reference pressure, and the flow of fluid through the flow-out side connection passage 53 is restricted when the pressure in the flow-in side connection passage 52 is equal to or greater than the reference pressure.

Hereinafter, operation of the pump unit will be described with reference to FIGS. 20 and 21.

An alternating current power is supplied to the piezoelectric element to cause the pump side diaphragm 49 to vibrate with the operation of the piezoelectric element.

When the pump side diaphragm 49 shifts in a direction to expand the pump chamber S1, the flow-in valve 50 opens, while the flow-out valve 51 closes. This allows fluid to flow into (be sucked into) the pump chamber S.

On the other hand, when the pump side diaphragm 49 shifts in a direction to contract the pump chamber S1, the flow-in valve 50 closes, while the flow-out valve 51 opens. This allows fluid to flow out of the pump chamber S1.

Further, when the pressure in the flow-in side connection passage 52 becomes equal to or greater than the reference pressure, the valve side diaphragm 47 resiliently deforms to come into close contact with the valve seat 55, to thereby restrict flow of fluid through the flow-out side connection passage 53.

Figure 19:
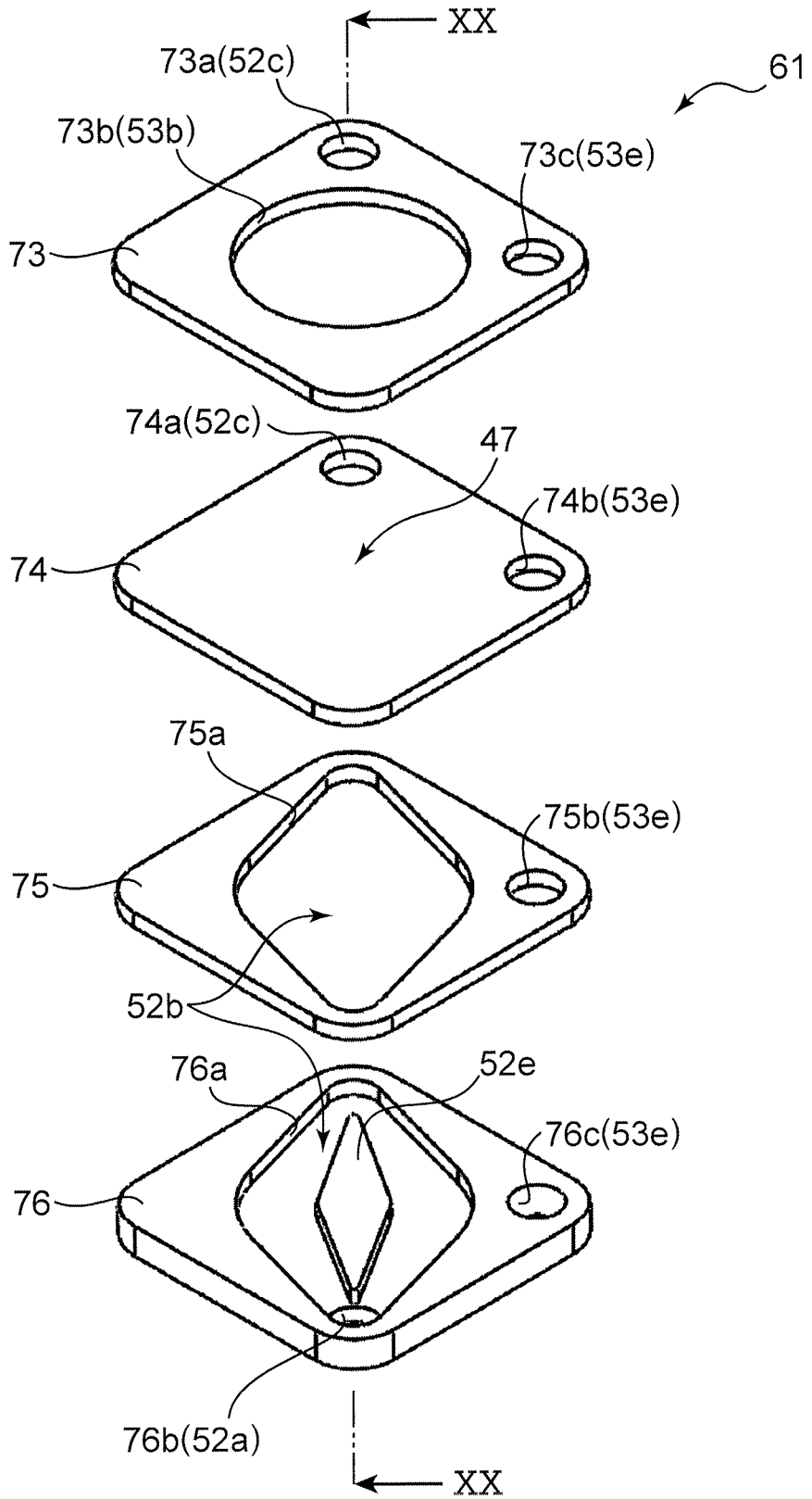
FIG. 19 is an exploded perspective view of a valve body section of the pump unit according to the second embodiment of the present invention.

As shown in FIGS. 18 and 19, the discharge mechanism 45 and the valve mechanism 43 of the pump unit are separately formed by joining the plurality of metal layer pieces 65 to 76 (including metal layer pieces 22 to 24 shown in FIG. 8) stacked in the stacking direction coincident with the central axis J by diffusion welding, and are secured to each other by diffusion welding.

Specifically, the discharge mechanism 45 is formed by the metal layer pieces 22 to 24 (see FIG. 8) and the metal layer pieces 65 to 68, and the valve mechanism 43 is formed by the metal layer pieces 69 to 76. The metal layer pieces 22 to 24 are the same as those of the first embodiment, and therefore, descriptions thereof will be omitted.

With reference to FIGS. 18 and 21, the fourth metal layer piece 65 includes two through-openings 65*a* constituting part of the flow-in passage 56, and a through-opening 65*b* constituting part of the flow-out passage 58. The through-openings 65*a* define a space for allowing the flow-in valve 51 to resiliently deform toward the pump chamber.

The fifth metal layer piece 66 includes the above-mentioned two flow-in valves 50, and a through-opening 66*a* constituting part of the flow-out passage 58.

The sixth metal layer piece 67 includes a through-opening 67*a* constituting part of the flow-out passage 58. The sixth metal layer piece 67 has one side surface formed with the above-mentioned two flow-in valve seats 57 and the other side surface formed with the flow-out valve seat 59 (not shown in FIG. 18). Further, a through-opening (shown without a reference character) that constitutes part of the flow-in passage 56 is formed inside the flow-in vale seat 57 of the sixth metal layer piece 67.

The seventh metal layer piece 68 includes two through-openings 68*a* constituting part of the flow-in passage 56, and a through opening 68*b* constituting part of the flow-out passage 58. The above-mentioned flow-out valve 51 is disposed in the through-opening 68*b* of the seventh metal layer piece 68. The flow-out valve 51 includes a closure portion (shown without a reference character) for closing the flow-out passage 58, and an arm (shown without a reference character) connecting the closure portion and a portion of the seventh metal layer piece 68 other than the closure portion (has a substantially same shape as the flow-in valve 50A shown in FIG. 28).

With reference to FIGS. 18 and 20, the eighth metal layer piece 69 includes two through-openings 69*a* constituting part of the connected portion 52*d* of the flow-in side connection passage 52, and a through-opening 69*b* constituting part of the connected portion 53*a* of the flow-out side connection passage 53.

The ninth metal layer piece 70 includes a through-opening 70*a* constituting part of the connected portion 52*d* of the flow-in side connection passage 52, a through-opening 70*b* constituting part of the connected portion 53*a* of the flow-out side connection passage 53, and a through-opening 70*c* constituting the third extension portion 53*d* of the flow-out side connection passage 53. Part of the stopper 54 lies in the through-opening 70*b* of the ninth metal layer piece 70.

The tenth metal layer piece 71 includes a through-opening 71*a* constituting part of the first extension portion 52*c* of the flow-in side connection passage 52, a through-opening 71*b* constituting part of the connected portion 53*a* of the flow-out side connection passage 53, a through-opening 71*c* constituting part of the second extension portion 53*c* of the flow-out side connection passage 53, and a through-opening 71*d* constituting part of the flow-out portion 53*e* of the flow-out side connection passage 53. Part of the stopper 54 lies in the through-opening 71*b* of the tenth metal layer piece 71.

The eleventh metal layer piece 72 includes a through-opening 72*a* constituting part of the second extension portion 52*c* of the flow-in side connection passage 52, a through-opening 72*b* constituting part of the connected portion 53*a* of the flow-out side connection passage 53, a through-opening 72*c* constituting part of the second extension portion 53*c* of the flow-out side connection passage 53, and a through-opening 72*d* constituting part of the flow-out portion 53*e* of the flow-out side connection passage 53. The above-mentioned valve seat 55 (not shown in FIG. 18) is disposed on a side surface of the eleventh metal layer piece 72 that lies closer to the valve side diaphragm 47.

With reference to FIGS. 19 and 20, the twelfth metal layer piece 73 includes the through-opening 73*a* constituting part of the first extension portion 52*c* of the flow-in side connection passage 52, the through-opening 73*b* constituting the first extension portion 53*b* of the flow-out side connection passage 53, and a through-opening 73*c* constituting part of the flow-out portion 53*e* of the flow-out side connection passage 53. The twelfth metal layer piece 73 corresponds to a flow-out side defining metal layer piece including the through-opening 73*b* that defines a movable area for the valve side diaphragm 47 to the flow-out side connection passage 53 in the thirteenth metal layer piece 74. Further, the twelfth metal layer piece 73 corresponds to a space creating metal layer piece including the through-opening (space creating opening) 73*b* that passes therethrough in the stacking direction for defining a space between the valve side diaphragm 47 and the valve seat 55. The through-openings 73*a*, 73*c* lie outside the pump chamber S1 in the plan view (not shown).

The thirteenth metal layer piece (valve side diaphragm metal layer piece) 74 includes the valve side diaphragm 47. Further, the thirteenth metal layer piece 74 includes the through-opening 74*a* constituting part of the first extension portion 52*c* of the flow-in side connection passage 52, and a through-opening 74*b* constituting part of the flow-out portion 53*e* of the flow-out side connection passage 53.

The fourteenth metal layer piece 75 includes a through-opening 75*a* constituting part of the second extension portion 52*b* of the flow-in side connection passage 52, and a through-opening 75*b* constituting part of the flow-out portion 53*e* of the flow-out side connection passage 53. The through-opening 75*a* corresponds to a flow-in side defining opening defining the movable area for the valve side diaphragm 47 to the flow-in side connection passage 52 in the thirteenth metal layer piece 74.

The fifteenth metal layer piece 76 includes a recess 76*a* constituting part of the second extension portion 52*b* of the flow-in side connection passage 52, a through-opening 76*b* disposed inside the recess 76*a* and constituting the flow-in portion 52*a* of the flow-in side connection passage 52, and a through-opening 76*c* disposed outside the recess 76*a* and constituting part of the flow-out portion 53*e* of the flow-out side connection passage 53. A projection 52*e* projecting toward the valve side diaphragm 47 is formed on a bottom surface of the recess 76*a* of the fifteenth metal layer piece 76.

With reference to FIGS. 19, 20, and 25, the flow-in portion 52*a*, the second extension portion 52*b* and the first extension portion 52*c* of the flow-in side connection passage 52 defined by the twelfth to fifteenth metal layer pieces 73 to 76 will be described.

The fourteenth metal layer piece 75 and the fifteenth metal layer piece 76 correspond to a recessed metal layer piece joined to the thirteenth metal layer piece 74 (valve diaphragm metal layer piece) and formed with a defining recess 77 (recess constituted by the through-opening 75*a* and the recess 76*a*) including a defining portion 77*a* (see FIG. 25) for defining a movable area for the valve side diaphragm 47. It should be noted that although the present embodiment illustrates a case where the recessed metal layer piece is constituted by the two metal layer pieces 75, 76, the recessed metal layer piece may be constituted by a single metal layer piece that is formed with a defining recess 77.

Here, the defining portion 77*a* is a portion of the defining recess 77 that overlaps the through-opening 73*b* of the twelfth metal layer piece 73 in the plan view.

The through-opening 76*b* (corresponding to the second connection opening) of the fifteenth metal layer piece 76 and the through-opening 74*a* (corresponding to the first connection opening) of the thirteenth metal layer piece 74 that connect with the defining recess 77 connect with defining recess 77 at an outside position of the defining portion 77*a* in the plan view, and are smaller than the defining portion 77*a* in the plan view.

The defining recess 77 includes a pair of extension portions 77*b* respectively extending and tapering from the defining portion 77*a* to the through-openings 76*b*, 74*a* in the plan view.

In this manner, the sectional area of the defining recess 77 of the recessed metal layer piece including the pair of extension portions 77*b* and the defining portion 77*a* varies from the through-opening 76*b* to the through-opening 74*a* in the plan view. Specifically, in the plan view, the sectional area of the defining recess 77 increases from the through-opening 76*b* to the defining portion 77*a*, and decreases from the defining portion 77*a* to the through-opening 74*a*.

Here, the recessed metal layer piece is provided with the projection 52*e* projecting from the bottom surface of the defining recess 77 toward the valve side diaphragm 47 at a position on a line connecting the through-opening 76*b* and the through-opening 74*a* and overlapping the defining portion 77*a* in the plan view. Thus, the projection is provided at the portion where the flow path sectional area is greatest in the defining recess 77 formed in the recessed metal layer piece as described. This makes it possible to reduce the sectional area of the portion to suppress variation in the flow rate distribution in the defining recess 77.

Specifically, in a case where the projection 52*e* is not provided, the flow rate of fluid is highest on the straight line connecting the through-opening 76*b* and the through-opening 74*a*, and on the other hand, the flow rate of fluid is low in regions R2 away from the straight line in the defining portion 77*a*, the regions R2 being shown in FIG. 25. In this state, air is liable to stagnate in the region R2. However, the provision of the projection 52*e* reduces the flow rate of fluid on the straight line and, in turn, increases the flow rate of fluid in the regions R2, which makes it possible to prevent the air stagnation in the regions R2.

It should be noted that FIGS. 18 and 19 show the fourth to fifteenth metal layer pieces 65 to 76 each in the form of a single metal plate, but alternatively, a plurality of metal plates may be stacked to be used for a metal layer piece with the front surface and the rear surface having the same shape. On the other hand, it is also possible to use a metal plate having a great thickness, but in this case, the surface roughness of the metal plate would be great, which would have a negative influence in the diffusion welding. Therefore, it is preferred to increase the thickness of a metal layer piece by using a plurality of thin metal plates as mentioned above.

As mentioned above, the valve side diaphragm 47 lies inside the pump side diaphragm 49 in the plan view. In other words, the entirety of the through-opening (flow-out side defining opening; see FIG. 19) 73*b* of the twelfth metal layer piece 73 and part of the through-opening (flow-in side defining opening; see FIG. 19) 75*a* of the fourteenth metal layer piece 75 lie inside the through-opening (pump chamber opening; see FIG. 8) 24*a* of the third metal layer piece 24 in the plan view. Therefore, the flow-in side connection passage 52 and the flow-out side connection passage 53 have respective portions that lie inside the pump side diaphragm 49 in the plan view between the diaphragms 47, 49.

Accordingly, the pump unit according to the second embodiment is formed, similarly to the first embodiment, by separately manufacturing a chamber section 19 including the first to third metal layer pieces 22 to 24, a valve body section 61 including the twelfth to fifteenth metal layer pieces 73 to 76, and an intermediate section 60 lying between the chamber section 19 and the valve body section 61.

Specifically, in the preparation step, between the twelfth metal layer piece 73 and the fourteenth metal layer piece 75 that define the movable area for the valve side diaphragm 47, the twelfth metal layer piece 73 is prepared as a proximate metal layer piece that is disposed closer to the pump chamber S1 (third metal layer piece 24), the twelfth metal layer piece 73 including no other opening than the plurality of through-openings (passage forming openings) 52*c*, 53*e* and the through-opening 73*b* in order to form the flow-in side connection passage 52 and the flow-out side connection passage 53, as shown in FIG. 19.

In addition, in the preparation step, the eleventh metal layer piece (adjacent metal layer piece) 72 is prepared that includes the through-openings (communication openings) 72*a*, 72*d* respectively having peripheral edges that can be brought into close contact with the peripheral edges of the through-openings (first passage forming openings) 52*c*, 53*e* of the plurality of through-openings 52*c*, 53*e*, as shown in FIG. 18.

Thereafter, the metal layer pieces 65 to 76 are joined by diffusion welding (joining step).

Specifically, the joining step includes an intermediate joining step (first joining step) of joining, among the metal layer pieces 65 to 76, metal layer pieces that are included in the intermediate section 60 (see FIG. 18), a chamber joining step of joining metal layer pieces that are included in the chamber section 19 (see FIG. 8) by diffusion welding, a valve body joining step of joining metal layer pieces that are included in the valve body section 61 (see FIG. 19) by diffusion welding, and an integral joining step (second joining step) of joining the chamber section 19, the valve body section 61, and the intermediate section 60 to one another.

In the intermediate joining step, as shown in FIG. 18, the intermediate section 60 is formed by diffusion welding separately from the chamber section 19 and the valve body section 61. Therefore, it is possible to reliably form, by diffusion welding, the respective portions of the connection passages 52, 53 that are defined in the intermediate section 60 and overlap the pump chamber S1 and the through-openings 73*b*, 75*a*, 76*b*.

In the chamber joining step, as shown in FIGS. 8 and 21, the first to third metal layer pieces 22 to 24 are joined. Alternatively, the first to third metal layer pieces 22 to 24 may be joined to the chamber section 19 in the integral joining step described later, omitting the chamber joining step.

In the valve body joining step, the twelfth to fifteenth metal layer pieces 73 to 76 are joined by diffusion welding as shown in FIGS. 19 and 20.

It should be noted that the order of the intermediate joining step, the chamber joining step, and the valve body joining step is not limited to the above-described one.

Thereafter, in the integral joining step, the chamber section 19, the intermediate section 60, and the valve body section 61 are joined by diffusion welding.

Specifically, in the integral joining step, as shown in FIGS. 18 to 20, diffusion welding is performed in a state in which the valve seat 55 and the through-opening (space creating opening) 73*b* of the twelfth metal layer piece (space creating metal layer piece) 73 overlap each other in the stacking direction and the twelfth metal layer piece 73 lies between the thirteenth metal layer piece 74 and the eleventh metal layer piece (valve seat metal layer piece) 72. Consequently, a space is defined between the valve seat 55 and the valve side diaphragm 47.

Further, in the integral joining step, diffusion welding is performed in a state in which the through-opening (flow-out side defining opening) 73*b* of the twelfth metal layer piece 73 and the defining portion 77*a* (see FIG. 25) of the through-opening (flow-inside defining opening) 75*a* of the fourteenth metal layer piece 75 lie inside the through-opening (pump chamber opening) 24*a* of the third metal layer piece 24 in the plan view. Consequently, the valve side diaphragm 47 lies inside the pump side diaphragm 49 in the plan view, which allows the pump unit 1 to be made compact in the direction perpendicularly intersecting the stacking direction.

Further, in the integral joining step, the intermediate section 60 and the valve body section 61 are joined by diffusion welding in a state in which the through-openings (passage forming openings) 73*a*, 73*c* of the twelfth metal layer piece 73 lie outside the through-opening 24*a* of the third metal layer piece 24 in the plan view. This makes it possible to transmit a pressure applied to the metal layer pieces 22 to 24 and 65 to 76 from a portion of the third metal layer piece 24 that lies outside the through-opening 24*a* to the other metal layer pieces in the integral joining step. Therefore, portions around the through-openings 73*a*, 73*c* of the twelfth metal layer piece 73 can be joined to the eleventh metal layer piece 72 by diffusion welding.

On the other hand, in the second embodiment, similarly to the first embodiment, expansion portions 22*b* formed in the first metal layer piece 22 overlap the through-openings 73*a*, 73*c* in the plan view, which makes it difficult to effectively transmit a pressure applied to the metal layer pieces 22 to 24 and 65 to 76 to respective portions around the through-openings 73*a*, 73*c* owing to the space within each expansion portion 22*b* in the integral joining step.

Accordingly, similarly to the first embodiment, in the integral joining step, the eleventh metal layer piece 72 and the twelfth metal layer piece 73 are joined by diffusion welding in a state in which the peripheral edges of the through-openings 73*a*, 73*c* of the twelfth metal layer piece 73 are in close contact with the peripheral edges of the through-openings 72*a*, 72*d* of the eleventh metal layer piece 72, respectively. The close contact of the peripheral edges makes it possible to suppress leakage of fluid through the gaps between the through-openings 72*a*, 72*d* and the through-openings 73*a*, 73*c* even in the above-mentioned structure in which a pressure is difficult to be sufficiently transmitted.

After the integral diffusion welding is performed, similarly to the first embodiment, a layer formation step is performed in which a connected layer 23*b* is formed on a side surface of the second metal layer piece 23 opposite from the pump chamber S1 via an insulating layer 23*a*, as shown in FIG. 11. In the layer formation step, the insulating layer 23*a* and the connected layer 23*b* are formed in a region extending from a position inside the through-opening 22*a* to positions inside the expansion portions 22*b* of the first metal layer piece 22.

Thereafter, an attachment step is performed in which the piezoelectric element 4 is attached to the second metal layer piece 23 with the first connection portion 4*a* of the piezoelectric element 4 being electrically connected to the connected portion 23*b*.

A plurality of pump units according to the second embodiment can be simultaneously manufactured by adopting the method of using a metal plate corresponding to the linkage metal plate 39 shown in FIG. 12 of the first embodiment.

As described above, the second embodiment can provides the following advantageous effects in addition to the advantageous effects provided by the first embodiment.

As shown in FIG. 25, the sectional area of the defining recess 77 of the fourteenth metal layer piece 75 and the fifteenth metal layer piece 76 (recessed metal layer piece) varies from the through-opening 76*b* to the through-opening 74*a* in the plan view.

Here, in the second embodiment, the projection 52*e* is provided that projects from the bottom surface of the defining recess 77 toward the valve side diaphragm 47 at the position on the straight line connecting the through-opening 76*b* and the through-opening 74*a* and overlapping the defining portion 77*a* in the plan view. Thus, the projection 52*e* is provided at the portion where the flow path sectional area is greatest in the defining recess 77. This makes it possible to reduce the sectional area of the portion to suppress variation in the flow rate distribution in the defining recess 77.

Therefore, it is possible to cause air to flow out in a time period ranging from several to several tens of seconds in the second embodiment, whereas it takes one to three hours (the period t1 or t2) to cause air to flow out in the first embodiment as shown in FIG. 17. As a result, in a case where liquid is caused to flow as fluid, for example, it is possible to suppress stagnation of air and, in turn, suppress reduction in the flow rate accuracy.

In addition, in the second embodiment, the flow-out valve 51 is disposed at the center of the pump chamber S1 in the plan view, and only the two flow-in valves 50 are disposed at point symmetrical positions with respect to the straight line passing through the center in the plan view, as shown in FIGS. 18 and 21.

Consequently, it is possible to cause fluid to flow to the flow-out valve 51 equally from the two places around the flow-out valve 51. Therefore, it is possible to suppress stagnation of fluid in the pump chamber S1.

Further, by limiting the number of flow-in valves 50 to two, it is possible to improve the deterioration of flow rate accuracy (see FIG. 15) with respect to pressure (back pressure) that occurs by providing the four flow-in valves 14 in the first embodiment, the deterioration being caused by an increase in the total leakage amount of the flow-in valves 14.

Figure 26:
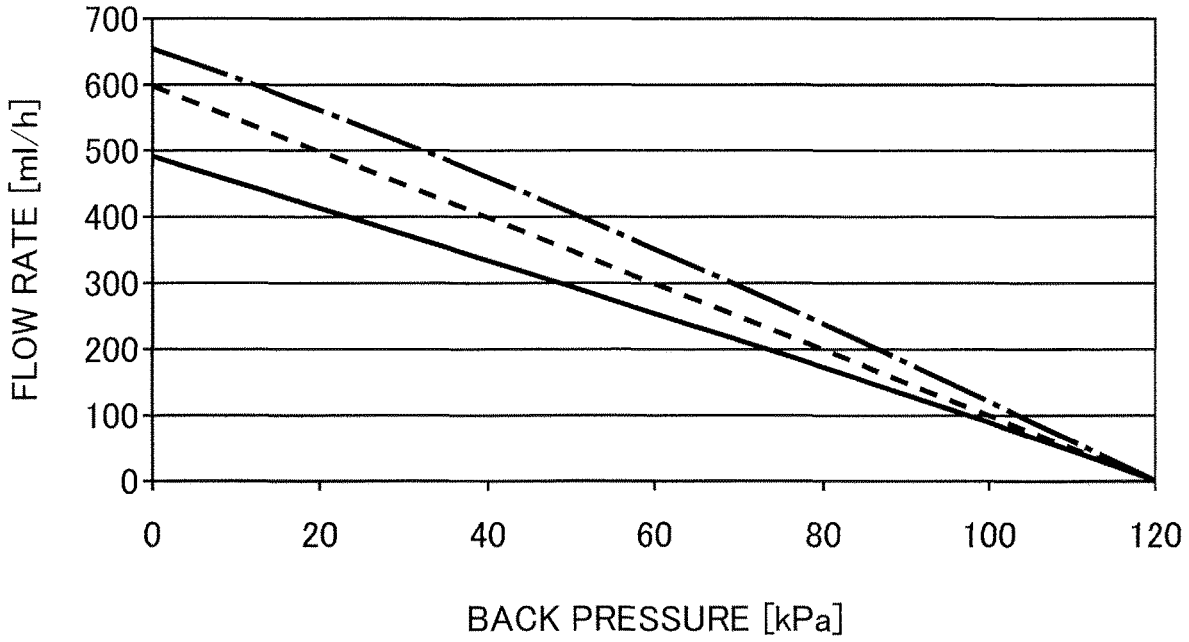
FIG. 26 is a graph showing a relation between flow rate and pressure (back pressure) of the pump unit according to the second embodiment.

Specifically, the second embodiment makes it possible to obtain a characteristic in which the flow rate changes linearly with respect to pressure (back pressure) as shown in FIG. 26. The solid line shown in FIG. 26 represents a case where the frequency of 100 Hz is used, the dashed line shown in FIG. 26 represents a case where the frequency of 150 Hz is used, and the dashed-dotted line shown in FIG. 26 represents a case where the frequency of 200 Hz is used.

Further, in the second embodiment, the flow-in valves 50 are used that have the length L2 shorter than the length L1 of the flow-in valves 14 of the first embodiment shown in FIG. 22. Specifically, the arm length of the flow-in valve 50 is shorter than the arm length of the flow-in valve 14.

Because the spring constant is small in the flow-in valve 14 of the first embodiment, it is difficult, when the pump side diaphragm 9 operates at a relatively high frequency, to cause the flow-in valve 14 to follow it according to the volume fluctuations in the pump chamber S1. This is considered to be a cause of deterioration of flow rate performance (see FIG. 16).

In contrast, in the second embodiment, the spring constant of the flow-in valve 50 is greater than in the first embodiment. This makes it possible, even when the pump side diaphragm 49 operates at a relatively high frequency, to cause the flow-in valve to follow it according to the volume fluctuations in the pump chamber S1.

Figure 27:
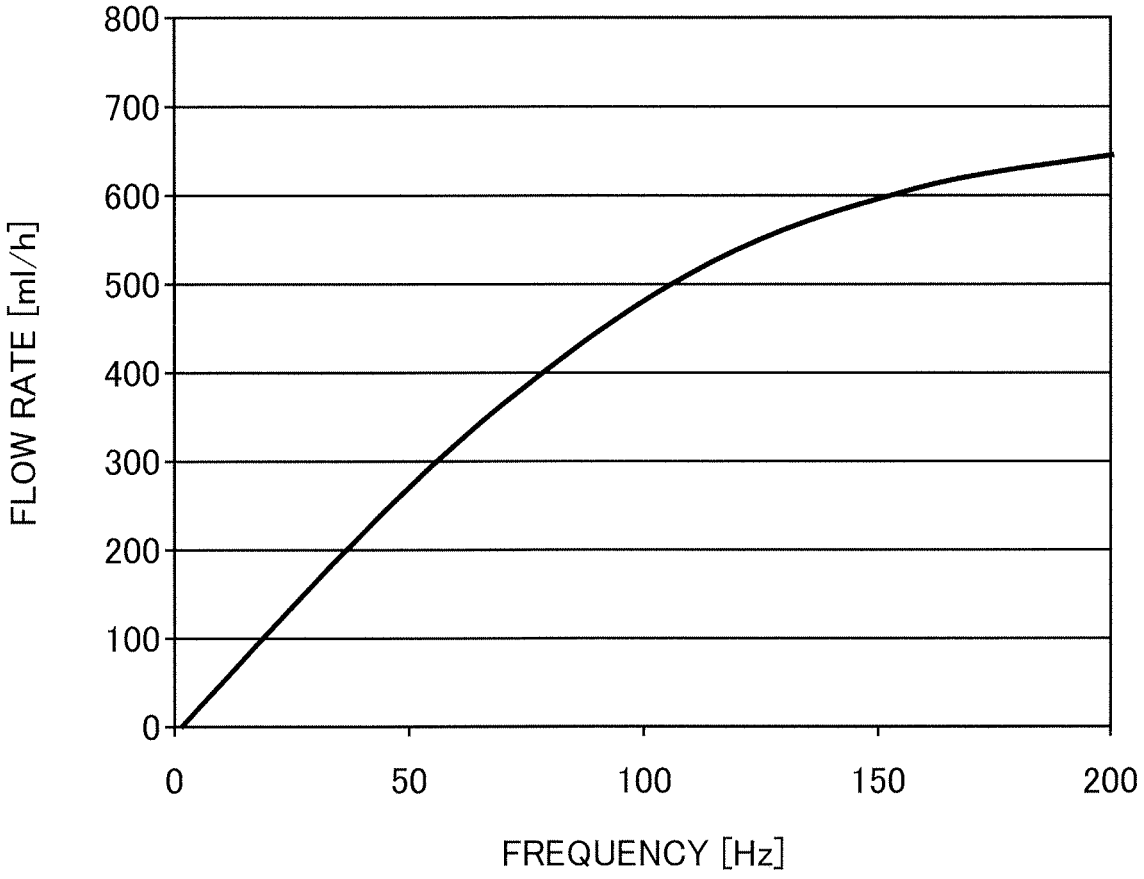
FIG. 27 is a graph showing a relation between flow rate and frequency of the pump unit according to the second embodiment.

As a result, the pump unit of the second embodiment makes it possible to obtain a flow rate characteristic that changes linearly according to change in frequency, as shown in FIG. 27. It should be noted that FIG. 27 shows a data obtained under the same condition (condition where a square wave [with a maximum voltage of +240V and a minimum voltage of −60V] is used) as the flow rate characteristics shown in FIG. 16.

It should be noted that, in the second embodiment, the shape of the flow-in valve 50 is not limited to the one shown in FIG. 23. For example, even in the case of using flow-in valves 50A to 50C shown in FIGS. 28 to 30, it is possible to obtain a flow rate characteristic that linearly changes according to change in frequency.

Figure 28:
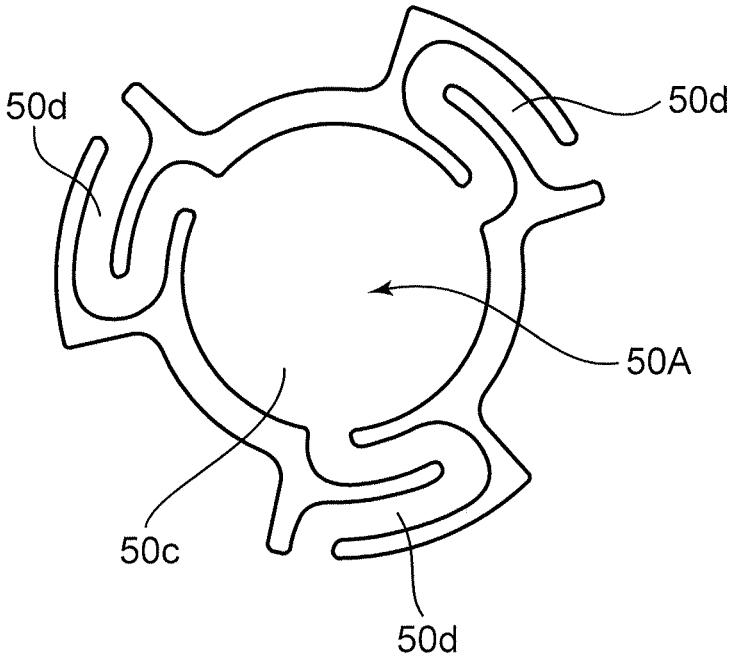
FIG. 28 is a plan view showing a modification of the flow-in valve of the pump unit according to the second embodiment.

Specifically, the flow-in valve 50A shown in FIG. 28 includes a closure portion 50*c* for closing the flow-in passage 56, and three arms 50*d* supporting the closure portion 50*c* in such a way as to allow the closure portion 50*c* to move between a position to close the flow-in passage 56 and a position to open the flow-in passage 56.

The closure portion 50*c* is supported at three positions by the arms 50*d*. This makes it possible to set a total spring constant of the three arms 50*d* great in the flow-in valve 50A as compared to the flow-in valve 14 shown in FIG. 22 that includes the closure portion 14*a* supported by the one arm 14*b*.

Further, the arms 50*d* have a different shape from the arm 50*b*, the shape having a plurality of bent portions. Further, the arm 50*d* are disposed at equally spaced three positions around the closure portion 50*c*. Owing to such bent shape and the arrangement of the arms 50*d*, the spring constant can be increased.

Figure 29:
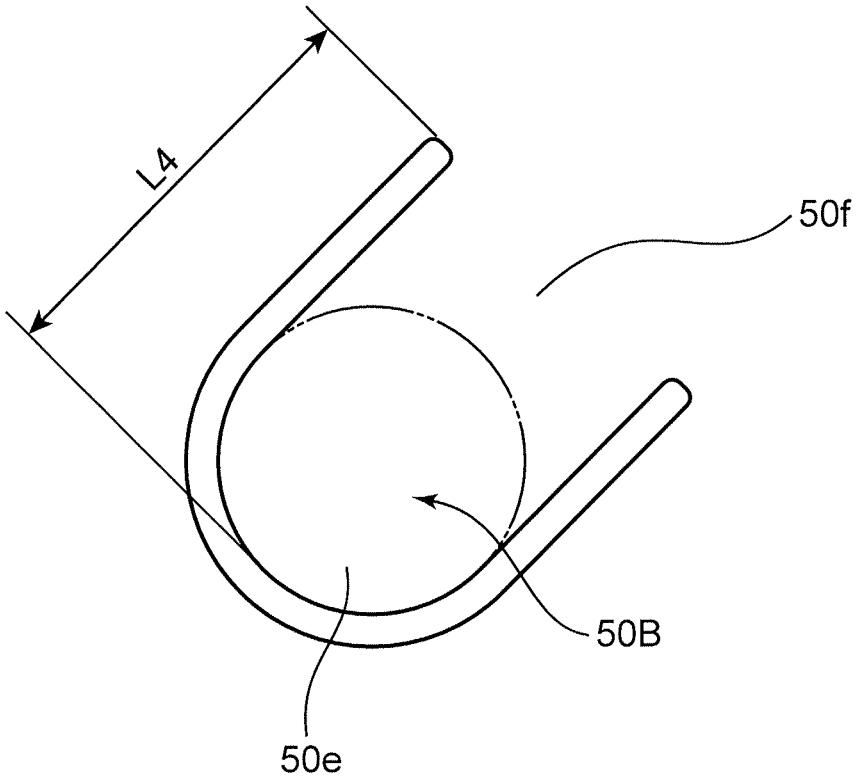
FIG. 29 is a plan view showing a modification of the flow-in valve of the pump unit according to the second embodiment.

The flow-in valve 50B shown in FIG. 29 includes a closure portion 50*e* for closing the flow-in passage 56, and an arm 50*f* supporting the closure portion 50*e* in such a way as to allow the closure portion 50*e* to move between a position to close the flow-in passage 56 and a position to open the flow-in passage 56. The closure portion 50*e* refers to a substantially circular portion (portion indicated by the dashed-two dotted line in the figure) having an area equivalent to the area of each of the closure portions 50*a*, 50*c* of the flow-in valves 50, 50A.

The length L4 of the flow-in valve 50B is slightly shorter than the length L2 (see FIG. 23) of the flow-in valve 50.

Figure 30:
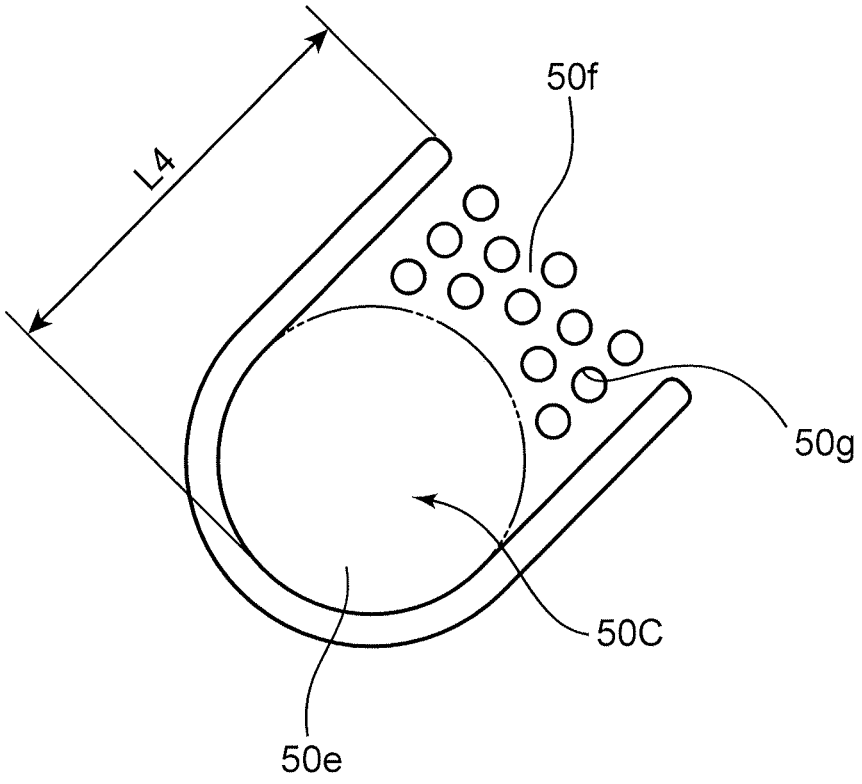
FIG. 30 is a plan view showing a modification of the flow-in valve of the pump unit according to the second embodiment.

The flow-in valve 50C shown in FIG. 30 is a modification of the flow-in valve 50B shown in FIG. 29 that additionally includes a through holes 50*g* formed in the arm 50*f*. Consequently, the spring constant of the flow-in valve 50C is set slightly smaller.

The present invention is not limited to the above-described embodiments, and may adopt the following configurations, for example.

In the above-described embodiment, the eleventh metal layer piece 32 is illustrated as an example of the proximate metal layer piece, the eleventh metal layer piece 32 including the through-opening 32*b* that defines a movable area for the valve side diaphragm 7 to the flow-out side connection passage 11. Alternatively, the thirteenth metal layer piece 34 may be used as the proximate metal layer piece, the thirteenth metal layer piece 34 including the through-opening 34*b* that defines a movable area for the valve-side diaphragm 7 to the flow-in side connection passage 10. In this case, the relative positions of the flow-in side connection passage 10 and the flow-out side connection passage 11 are reversed with respect to the valve-side diaphragm 7.

In the above-described embodiments, the connected layer 23*b* is formed on the side surface of the second metal layer piece 23 opposite from the pump chamber S1 via the insulating layer 23*a*, as shown in FIG. 11. However, the connected layer 23*b* is not limitedly provided in the pump unit. For example, a connected layer may be provided in the piezoelectric element 4 in advance, the connected layer being electrically connected to the first connection portion 4*a* of the piezoelectric element 4 and extending from the first connection portion 4*a* to an end surface of the piezoelectric element 4 where the second connection portion 4*b* lies. In this case, it is possible to omit the step of providing the connected layer 23*b* to the pump unit.

The above-described specific embodiments mainly include the invention having the following configurations.

In order to achieve the above-mentioned object, the present invention provides a pump unit, comprising: a pump including a piezoelectric element and a discharge mechanism for discharging fluid according to operation of the piezoelectric element; and a valve mechanism attached to the pump, wherein: the discharge mechanism includes a pump body, a pump side diaphragm defining a pump chamber in cooperation with the pump body, at least one flow-in valve that is disposed in a flow-in passage defined in the pump body and connecting with the pump chamber, and a flow-out valve that is disposed in a flow-out passage defined in the pump body and connecting with the pump chamber; the valve mechanism includes a valve mechanism body having a flow-in side connection passage connecting with the flow-in passage, and a flow-out side connection passage connecting with the flow-out passage, and a valve side diaphragm disposed in the valve mechanism body and dividing the flow-in side connection passage from the flow-out side connection passage; the flow-in valve is allowed to open when a pressure on an upstream side of the flow-in valve is greater than a pressure in the pump chamber; the flow-out valve is allowed to open when the pressure in the pump chamber is greater than a pressure on a downstream side of the flow-out valve; the valve side diaphragm is allowed to restrict flow of fluid through the flow-out side connection passage when a pressure in the flow-in side connection passage is greater than a pressure in the flow-out side connection passage; and the discharge mechanism and the valve mechanism each include a plurality of metal layer pieces stacked in a predetermined stacking direction and joined to one another by diffusion welding, the discharge mechanism and the valve mechanism being secured to each other by diffusion welding.

According to the pump unit of the present invention, the discharge mechanism and the valve mechanism are separately formed by joining the plurality of metal layer pieces by diffusion welding, and the mechanisms are secured to each other by diffusion welding. Therefore, it is possible to omit a step such as bonding for forming each of the discharge mechanism and the valve mechanism, and eliminate the necessity to form a gasket in the joint between the discharge mechanism and the valve mechanism as in conventional cases.

A pump unit manufacturing method according to the present invention includes: a preparation step of preparing a plurality of metal layer pieces for forming the discharge mechanism and the valve mechanism; a joining step of joining the plurality of metal layer pieces by diffusion welding; and an attachment step of attaching the piezoelectric element to the discharge mechanism.

Thus, according to the present invention, it is possible to provide a pump unit with a reduced number of components and simplify a manufacturing process thereof.

Here, the flow-out side connection passage may be closed by the valve side diaphragm when no pressure difference occurs between the flow-in side connection passage and the flow-out side connection passage. In this case, however, because the valve side diaphragm is also made of metal, a pressure loss occurs when the valve side diaphragm opens to discharge fluid, which makes it difficult to stably discharge fluid.

Accordingly, in the above-described pump unit, it is preferred that the valve mechanism body further includes a valve seat operable to come into contact with the valve side diaphragm to thereby restrict the flow of fluid through the flow-out side connection passage, and that the valve side diaphragm is spaced from the valve seat and has an elasticity to deform to come into contact with the valve seat when the pressure in the flow-in side connection passage is greater than the pressure in the flow-out side connection passage.

According to this configuration, the flow-out side connection passage is open when the pressure in the flow-in side connection passage is smaller than that when the valve side diaphragm is deformed (i.e. when no abnormal pressure occurs in the flow-in side connection passage). Therefore, it is possible to prevent the above-mentioned pressure loss to thereby realize a stable fluid discharge.

As the above-mentioned pump unit manufacturing method, a method may be adopted wherein: the valve mechanism body further includes a valve seat operable to come into contact with the valve side diaphragm to thereby restrict the flow of fluid through the flow-out side connection passage; in the preparation step, a valve side diaphragm metal layer piece including the valve side diaphragm, a valve seat metal layer piece including the valve seat, and a space creating metal layer piece including a space creating opening passing therethrough in the stacking direction are prepared; in the joining step, diffusion welding is performed in a state in which the valve seat and the space creating opening overlap each other in the stacking direction and the space creating metal layer piece lies between the valve side diaphragm metal layer piece and the valve seat metal layer piece; and the valve side diaphragm has an elasticity to deform to come into contact with the valve seat when the pressure in the flow-in side connection passage is greater than the pressure in the flow-out side connection passage.

According to this configuration, it is possible to manufacture a pump unit capable of preventing the pressure loss as mentioned above by placing the space creating metal layer piece between the valve seat metal layer piece and the valve side diaphragm metal layer piece and joining these metal layer pieces to one another by diffusion welding.

Here, the valve side diaphragm may be disposed outside the pump side diaphragm in plan view looking at the pump unit in the stacking direction. However, in this case, the pump unit would have a greater size in a direction perpendicularly intersecting the stacking direction, which would reduce the flexibility of layout of the pump unit.

Accordingly, in the above-described pump unit, it is preferred that the plurality of metal layer pieces include a pump chamber metal layer piece formed with a pump chamber opening defining the pump chamber, a valve side diaphragm metal layer piece having the valve side diaphragm, a flow-in side defining metal layer piece joined to the valve side diaphragm metal layer piece, and formed with a flow-in side defining opening that defines a movable area for the valve side diaphragm to the flow-in side connection passage, and a flow-out side defining metal layer piece joined to the valve side diaphragm metal layer piece, and formed with a flow-out side defining opening that defines a movable area for the valve side diaphragm to the flow-out side connection passage, and that the flow-in side defining opening and the flow-out side defining opening lie inside the pump chamber opening in plan view looking at the pump unit in the stacking direction.

According to this configuration, the valve side diaphragm lies inside the pump side diaphragm in the plan view. This allows the pump unit to be made compact in the direction perpendicularly intersecting the stacking direction and makes it possible to improve the flexibility of layout of the pump unit.

As the above-mentioned pump unit manufacturing method, a method may be adopted wherein: in the preparation step, a pump chamber metal layer piece formed with a pump chamber opening defining the pump chamber, a valve side diaphragm metal layer piece having the valve side diaphragm, a flow-in side defining metal layer piece formed with a flow-in side defining opening that defines a movable area for the valve-side diaphragm to the flow-in side connection passage, and a flow-out defining metal layer piece formed with a flow-out side defining opening that defines a movable area for the valve side diaphragm to the flow-out side connection passage are prepared; and in the joining step, diffusion welding is performed in a state in which the flow-in side defining opening and the flow-out side defining opening lie inside the pump chamber opening in plan view looking at the pump unit in the stacking direction.

According to this configuration, it is possible to manufacture a pump unit capable of improving the flexibility of layout as mentioned above by performing diffusion welding with the flow-in side defining opening and the flow-out side defining opening being positioned with respect to the pump chamber opening.

As mentioned above, when the valve side diaphragm lies inside the pump side diaphragm in the plan view, the flow-in side connection passage (flow-in side defining opening) or the flow-out side connection passage (flow-out side defining opening) lies between the valve side diaphragm and the pump side diaphragm. Thus, the flow-in side connection passage or the flow-out side connection passage has a portion (hereinafter, referred to as "inner lying portion") that lies inside the pump chamber in the plan view between the valve side diaphragm and the pump side diaphragm.

Here, in the diffusion welding, it is necessary to apply a pressure to the stacked plurality of metal layer pieces in the stacking direction, but it is difficult to effectively transmit the pressure to portions of the metal layer pieces that overlap the pump chamber (space). This makes it difficult to form the inner lying portion of the pump flow-in side connection passage or the flow-out side connection passage by diffusion welding.

Accordingly, in the above-described pump unit, it is preferred that a proximate metal layer piece that is one of the flow-in side defining metal layer piece and the flow-out side defining metal layer piece that is closer to the pump chamber metal layer piece includes no other opening than a plurality of passage forming openings and one of the flow-in side defining opening and the flow-out side defining opening in order to form the flow-in side connection passage and the flow-out side connection passage, and that the plurality of passage forming openings lie outside the pump chamber opening in the plan view.

According to this configuration, among the plurality of metal layer pieces, those (hereinafter, referred to as "intermediate section") stacked between the proximity metal layer piece and the pump chamber metal layer piece are joined by diffusion welding, separately from the other metal layer pieces. This makes it possible to reliably form the inner lying portion in the intermediate section.

Further, according to the above-described configuration, the passage forming openings lie outside the pump chamber opening in the plan view. Therefore, by joining all of the plurality of metal layer pieces by diffusion welding, it is possible to apply a pressure to respective peripheral portions of the passage forming openings of the proximate metal layer piece even via the pump chamber metal layer piece including the pump chamber opening.

Therefore, it is possible to provide the pump unit in which the flow-in side connection passage and the flow-out side connection passage are appropriately formed.

Specifically, as the above-mentioned pump unit manufacturing method, a method may be adopted wherein: in the preparation step, one of the flow-in side defining metal layer piece and the flow-out side defining metal layer piece that is closer to the pump chamber metal layer piece is prepared as a proximate metal layer piece that includes no other opening than a plurality of passage forming openings and one of the flow-in side defining opening and the flow-out side defining opening in order to form the flow-in side connection passage and the flow-out side connection passage; and the joining step includes a first joining step of joining the proximate metal layer piece, the pump chamber metal layer piece, and one or more of the plurality of metal layer pieces stacked therebetween by diffusion welding, and a second joining step of joining some of the plurality of metal layer pieces that have been joined in the first step and the other of the plurality of metal layer pieces by diffusion welding in a state in which the plurality of passage forming openings lie outside the pump chamber opening in the plan view.

According to this configuration, the joining step includes the first and second joining steps to make it possible to form the inner lying portion in the first joining step, and apply a pressure to the respective peripheral portions of the passage forming openings even via the pump chamber metal layer piece including the pump chamber opening in the second joining step.

Here, even when the proximate metal layer piece that includes the passage forming openings lying outside the pump chamber opening in the plan view is used as mentioned above, there are cases where another metal layer piece including an opening that overlaps the passage forming opening in the plan view has to be used. In this case, even when the above-mentioned manufacturing method is adopted, it is difficult to apply diffusion welding to the peripheral portion of the passage forming opening of the proximate metal layer piece.

Accordingly, in the above-described pump unit, it is preferred that the plurality of metal layer pieces include an adjacent metal layer piece joined to a side surface of the proximate metal layer piece that is closer to the pump chamber metal layer piece, and the adjacent metal layer piece is formed with a communication opening having a peripheral edge lying in close contact with a peripheral edge of a first passage forming opening among the plurality of passage forming openings.

According to this configuration, the proximate metal layer piece and the adjacent metal layer piece are joined by diffusion welding in a state in which the peripheral edge of the first passage forming opening of the proximate layer piece is in close contact with the peripheral edge of the communication opening of the adjacent metal layer piece.

This makes it possible, even when another metal layer piece including an opening that overlaps the first passage forming opening is used, to suppress leakage of fluid through the joint between the first passage forming opening and the communication opening, owing to their close contact.

Specifically, as the above-described pump unit manufacturing method, a method may be used wherein: in the preparation step, an adjacent metal layer piece is prepared that includes a communication opening having a peripheral edge able to come into close contact with a peripheral edge of a first passage forming opening among the plurality of passage forming openings; and in the second joining step, the adjacent metal layer piece is joined to a side surface of the proximate plate that is closer to the pump chamber metal layer piece in a state in which the peripheral edge of the first passage forming opening is in close contact with the peripheral edge of the communication opening.

According to this configuration, even when another metal layer piece including an opening that overlaps the first passage forming opening is used, it is possible to suppress leakage of fluid through the joint between the first passage forming opening and the communication opening by joining the proximate metal layer piece and the adjacent metal layer piece by diffusion welding in the state in which the peripheral edge of the first passage forming opening is in close contact with the peripheral edge of the communication opening in the second joining step.

Here, the movable area for the valve side diaphragm can be defined by a recess formed in a metal layer piece adjacent thereto. In this case, it is desired to make the recess (area of the movable area for the valve side diaphragm) as large as possible in order to improve the response to the pressure of the valve side diaphragm. On the other hand, a connection passage connecting with the recess needs to be smaller than the recess to reduce the size of the pump unit. In order to satisfy such requirements, the sectional area varies in a passage extending from the recess to the connection passage, and therefore, the flow rate distribution is uneven in the passage extending from the recess to the connection passage. Consequently, in a case where liquid is caused to flow as fluid, for example, there is a possibility that air stagnates in the passage to cause reduction in the flow rate accuracy.

Accordingly, in the above-described pump unit, it is preferred that the plurality of metal layer pieces include a valve side diaphragm metal layer piece having the valve side diaphragm, and a recessed metal layer piece joined to the valve side diaphragm metal layer piece and formed with a defining recess having a defining portion that defines a movable area for the valve side diaphragm, that the valve side diaphragm metal layer piece includes a first connection opening connecting with the defining recess at an outside position of the defining portion in plan view looking at the pump unit in the stacking direction, and smaller than the defining portion in the plan view, that the recessed metal layer piece includes a second connection opening connecting with the defining recess at an outside position of the defining portion in the plan view, and smaller than the defining portion in the plan view, that the defining recess includes a pair of extension portions respectively extending and tapering from the defining portion to the first connection opening and the second connection opening in the plan view, and that the recessed metal layer piece includes a projection projecting from a bottom surface of the defining recess toward the valve side diaphragm and disposed on a line connecting the first connection opening and the second connection opening, the projection overlapping the defining portion, in the plan view.

The sectional area of the defining recess of the recessed metal layer piece including the pair of extension portions and the defining portion varies from the first connection opening to the second connection opening in the plan view. Specifically, in the plan view, the sectional area of the defining recess increases from the first connection opening to the defining portion, and decreases from the defining portion to the second connection opening.

Here, in the above-described configuration, the recessed metal layer piece is provided with the projection projecting from the bottom surface of the defining recess toward the valve side diaphragm at the position on the line connecting the first connection opening and the second connection opening and overlapping the defining portion in the plan view. Thus, the projection is provided at the portion where the flow path sectional area is greatest in the defining recess formed in the recessed metal layer piece as described. This makes it possible to reduce the sectional area of the portion to suppress variation in the flow rate distribution in the defining recess.

Therefore, because it is possible to suppress variation in the flow rate distribution in the defining recess, it is possible to prevent stagnation of air to thereby suppress reduction in the flow rate accuracy in a case where liquid is caused to flow as fluid, for example.

Here, there are cases where the piezoelectric element includes a connection portion for allowing a power source to be connected thereto.

In this case, it is possible to bring the connection portion of the piezoelectric element into direct contact with the pump side diaphragm, and electrically connect the power source to the plurality of metal layer pieces, for example.

However, because the discharge mechanism and the valve mechanism are made of metal, when the power source is connected to the pump unit as mentioned above, electric current flows through liquid in the pump chamber in a case where the liquid has conductivity. Therefore, a problem may occur depending on the use of the liquid.

Accordingly, in the above-described pump unit, it is preferred that the plurality of metal layer pieces include a pump side diaphragm metal layer piece having the pump side diaphragm, that the piezoelectric element includes a connection portion for allowing a power source to be connected thereto, and that the pump side diaphragm metal layer piece has a surface opposite from the pump chamber, the surface is formed with a connected layer electrically connected to the connection portion via an insulating layer.

According to this configuration, it is possible to prevent flow of electric current through fluid in the pump chamber owing to the insulating layer. Therefore, the pump unit can be applied to uses (for example, as a medical fluid injection pump for medical use) in which the flow of electric current through fluid is restricted.

Specifically, as the above-mentioned pump unit manufacturing method, a method may be adopted wherein: in the preparation step, a pump side diaphragm metal layer piece including the pump side diaphragm is prepared, the pump unit manufacturing method further includes a layer forming step of forming a connected layer on a surface of the pump side diaphragm metal layer piece opposite from the pump chamber via an insulating layer, wherein in the attachment step, the piezoelectric element is attached to the pump side diaphragm metal layer piece in a state in which a connection portion provided in the piezoelectric element is electrically connected to the connected layer.

According to this configuration, it is possible to manufacture a pump unit capable of preventing flow of electric current through fluid in the pump chamber by, after forming an insulating layer and a connected layer in the layer forming step, attaching the piezoelectric element to the pump side diaphragm metal layer piece with the connection portion being electrically connected to the connected layer.

Here, in a case where the pump chamber has a circular shape in the plan view, it is possible to dispose the flow-out valve at a center of the pump chamber in the plan view and a plurality of flow-in valves at axially symmetrical positions with respect to a straight line passing through the center of the pump chamber in the plan view. Consequently, it is possible to cause fluid to flow to the flow-out valve equally from the plurality of places around the flow-out valve. This makes it possible to suppress stagnation of fluid in the pump chamber. Therefore, it is possible to ease a problem such as stagnation of air in the pump chamber that leads to reduction in the flow rate accuracy in a case where liquid is caused to flow as fluid, for example.

On the other hand, the flow-in valve is configured to close the flow-in passage using the rigidity of the metal layer piece. Therefore, there is a possibility that a small leakage may occur through the flow-in passage even when the flow-in valve is closed. Therefore, if the number of flow-in valves is great, the total amount of leakage of fluid through the flow-in valves may increase to reduce the flow rate accuracy.

Accordingly, in the above-described pump unit, it is preferred that the pump chamber has a circular shape in plan view looking at the pump unit in the stacking direction, that the flow-out valve is disposed at a center of the pump chamber in the plan view, and that there are provided two flow-in valves including no other valve than a flow-in valve being disposed at an axially symmetrical position to the at least one flow-in valve with respect to a straight line passing through the center of the pump chamber in the plan view.

According to this configuration, only the two flow-in valves are disposed at axially symmetrical positions with respect to the straight line passing through the center of the pump chamber. Consequently, it is possible to maximally suppress increase in the amount of leakage through the flow-in valves while reducing the above-mentioned stagnation of fluid in the pump chamber.

In the above-described pump unit manufacturing method, it is preferred that in the preparation step, there are prepared linkage metal plates each having a specified number of metal layer pieces of one of the plurality of metal layer pieces, the specified number of metal layer pieces being linked to one another, and in the joining step, the plurality of linkage metal plates are joined to one another by diffusion welding to make a plurality of units each including the discharge mechanism and the valve mechanism, and that the pump unit manufacturing method further comprises a cutting step of cutting the linkage metal plates into the units after the joining step.

According to this configuration, it is possible to manufacture a plurality of pump units without performing the joining step a plurality of times. Consequently, it is possible to further improve the manufacturing efficiency of pump units.

The invention claimed is:

1. A pump unit, comprising:

a pump including a piezoelectric element and a discharge mechanism for discharging fluid according to operation of the piezoelectric element; and a valve mechanism attached to the pump, wherein:

the discharge mechanism includes a pump body, a pump side diaphragm defining a pump chamber in cooperation with the pump body, at least one flow-in valve that is disposed in a flow-in passage defined in the pump body and connecting with the pump chamber, and a flow-out valve that is disposed in a flow-out passage defined in the pump body and connecting with the pump chamber;

the valve mechanism includes a valve mechanism body having a flow-in side connection passage connecting with the flow-in passage, and a flow-out side connection passage connecting with the flow-out passage, and a valve side diaphragm disposed in the valve mechanism body and dividing the flow-in side connection passage from the flow-out side connection passage;

the flow-in valve is allowed to open when a pressure on an upstream side of the flow-in valve is greater than a pressure in the pump chamber;

the flow-out valve is allowed to open when the pressure in the pump chamber is greater than a pressure on a downstream side of the flow-out valve;

the valve side diaphragm is allowed to restrict flow of fluid through the flow-out side connection passage when a pressure in the flow-in side connection passage is greater than a pressure in the flow-out side connection passage;

the discharge mechanism and the valve mechanism each include a plurality of metal layer pieces stacked in a predetermined stacking direction and joined to one another by diffusion welding, a peripheral edge of the discharge mechanism and a peripheral edge of the valve mechanism being secured to each other by diffusion welding; and the flow-in side connection passage and the flow-out side connection passage are located within the peripheral edge of the discharge mechanism and the peripheral edge of the valve mechanism in a view along the stacking direction.

2. The pump unit according to claim 1, wherein:

the valve mechanism body further includes a valve seat operable to come into contact with the valve side diaphragm to thereby restrict the flow of fluid through the flow-out side connection passage; and the valve side diaphragm is spaced from the valve seat and has an elasticity to deform to come into contact with the valve seat when the pressure in the flow-in side connection passage is greater than the pressure in the flow-out side connection passage.

3. The pump unit according to claim 1, wherein:

the plurality of metal layer pieces include a pump side diaphragm metal layer piece having the pump side diaphragm;

the piezoelectric element includes a connection portion for allowing a power source to be connected thereto; and the pump side diaphragm metal layer piece has a surface opposite from the pump chamber, the surface is formed with a connected layer electrically connected to the connection portion via an insulating layer.

4. The pump unit according to claim 1, wherein:

the pump chamber has a circular shape in plan view looking at the pump unit in the stacking direction;

the flow-out valve is disposed at a center of the pump chamber in the plan view; and there are provided two flow-in valves with one of the two flow-in valves being disposed at an axially symmetrical position relative to the other of the two flow-in valves with respect to a straight line passing through the center of the pump chamber in the plan view.

5. A pump unit manufacturing method for manufacturing the pump unit according to claim 1, comprising:

a preparation step of preparing a plurality of metal layer pieces for forming the discharge mechanism and the valve mechanism;

a joining step of joining the plurality of metal layer pieces by diffusion welding; and an attachment step of attaching the piezoelectric element to the discharge mechanism.

6. The pump unit manufacturing method according to claim 5, wherein:

the valve mechanism body further includes a valve seat operable to come into contact with the valve side diaphragm to thereby restrict the flow of fluid through the flow-out side connection passage;

in the preparation step, a valve side diaphragm metal layer piece including the valve side diaphragm, a valve seat metal layer piece including the valve seat, and a space creating metal layer piece including a space creating opening passing therethrough in the stacking direction are prepared;

in the joining step, diffusion welding is performed in a state in which the valve seat and the space creating opening overlap each other in the stacking direction and the space creating metal layer piece lies between the valve side diaphragm metal layer piece and the valve seat metal layer piece; and the valve side diaphragm has an elasticity to deform to come into contact with the valve seat when the pressure in the flow-in side connection passage is greater than the pressure in the flow-out side connection passage.

7. The method for manufacturing a pump unit according to claim 5, wherein:

in the preparation step, a pump chamber metal layer piece formed with a pump chamber opening defining the pump chamber, a valve side diaphragm metal layer piece having the valve side diaphragm, a flow-in side defining metal layer piece formed with a flow-in side defining opening that defines a movable area for the valve-side diaphragm to the flow-in side connection passage, and a flow-out defining metal layer piece formed with a flow-out side defining opening that defines a movable area for the valve side diaphragm to the flow-out side connection passage are prepared; and in the joining step, diffusion welding is performed in a state in which the flow-in side defining opening and the flow-out side defining opening lie inside the pump chamber opening in plan view looking at the pump unit in the stacking direction.

8. The method for manufacturing a pump unit according to claim 7, wherein:

in the preparation step, one of the flow-in side defining metal layer piece and the flow-out side defining metal layer piece that is closer to the pump chamber metal layer piece is prepared as a proximate metal layer piece that includes no other opening than a plurality of passage forming openings and one of the flow-in side defining opening and the flow-out side defining opening in order to form the flow-in side connection passage and the flow-out side connection passage; and the joining step includes a first joining step of joining the proximate metal layer piece, the pump chamber metal layer piece, and one or more of the plurality of metal layer pieces stacked therebetween by diffusion welding, and a second joining step of joining some of the plurality of metal layer pieces that have been joined in the first step and the other of the plurality of metal layer pieces by diffusion welding in a state in which the plurality of passage forming openings lie outside the pump chamber opening in the plan view.

9. The method for manufacturing a pump unit according to claim 8, wherein:

in the preparation step, an adjacent metal layer piece is prepared that includes a communication opening having a peripheral edge able to come into close contact with a peripheral edge of a first passage forming opening among the plurality of passage forming openings; and in the second joining step, the adjacent metal layer piece is joined to a side surface of the proximate plate that is closer to the pump chamber metal layer piece in a state in which the peripheral edge of the first passage forming opening is in close contact with the peripheral edge of the communication opening.

10. The method for manufacturing a pump unit according to claim 5, wherein, in the preparation step, a pump side diaphragm metal layer piece including the pump side diaphragm is prepared, the pump unit manufacturing method further comprises:

a layer forming step of forming a connected layer on a surface of the pump side diaphragm metal layer piece opposite from the pump chamber via an insulating layer, wherein, in the attachment step, the piezoelectric element is attached to the pump side diaphragm metal layer piece in a state in which a connection portion provided in the piezoelectric element is electrically connected to the connected layer.

11. The pump unit manufacturing method according to claim 5, wherein:

in the preparation step, there are prepared linkage metal plates each having a specified number of metal layer pieces of one of the plurality of metal layer pieces, the specified number of metal layer pieces being linked to one another; and in the joining step, the plurality of linkage metal plates are joined to one another by diffusion welding to make a plurality of units each including the discharge mechanism and the valve mechanism, the pump unit manufacturing method further comprising a cutting step of cutting the linkage metal plates into the units after the joining step.

12. A pump unit, comprising:

a pump including a piezoelectric element and a discharge mechanism for discharging fluid according to operation of the piezoelectric element; and a valve mechanism attached to the pump, wherein:

the discharge mechanism includes a pump body, a pump side diaphragm defining a pump chamber in cooperation with the pump body, at least one flow-in valve that is disposed in a flow-in passage defined in the pump body and connecting with the pump chamber, and a flow-out valve that is disposed in a flow-out passage defined in the pump body and connecting with the pump chamber;

the valve mechanism includes a valve mechanism body having a flow-in side connection passage connecting with the flow-in passage, and a flow-out side connection passage connecting with the flow-out passage, and a valve side diaphragm disposed in the valve mechanism body and dividing the flow-in side connection passage from the flow-out side connection passage;

the flow-in valve is allowed to open when a pressure on an upstream side of the flow-in valve is greater than a pressure in the pump chamber;

the flow-out valve is allowed to open when the pressure in the pump chamber is greater than a pressure on a downstream side of the flow-out valve;

the valve side diaphragm is allowed to restrict flow of fluid through the flow-out side connection passage when a pressure in the flow-in side connection passage is greater than a pressure in the flow-out side connection passage;

the discharge mechanism and the valve mechanism each include a plurality of metal layer pieces stacked in a predetermined stacking direction and joined to one another by diffusion welding, the discharge mechanism and the valve mechanism being secured to each other by diffusion welding;

the plurality of metal layer pieces include a pump chamber metal layer piece formed with a pump chamber opening defining the pump chamber, a valve side diaphragm metal layer piece having the valve side diaphragm, a flow-in side defining metal layer piece joined to the valve side diaphragm metal layer piece, and formed with a flow-in side defining opening that defines a movable area for the valve side diaphragm to the flow-in side connection passage, and a flow-out side defining metal layer piece joined to the valve side diaphragm metal layer piece, and formed with a flow-out side defining opening that defines a movable area for the valve side diaphragm to the flow-out side connection passage; and the flow-in side defining opening and the flow-out side defining opening lie inside the pump chamber opening in plan view looking at the pump unit in the stacking direction.

13. The pump unit according to claim 12, wherein:

a proximate metal layer piece that is one of the flow-in side defining metal layer piece and the flow-out side defining metal layer piece that is closer to the pump chamber metal layer piece includes no other opening than a plurality of passage forming openings and one of the flow-in side defining opening and the flow-out side defining opening in order to form the flow-in side connection passage and the flow-out side connection passage; and the plurality of passage forming openings lie outside the pump chamber opening in the plan view.

14. The pump unit according to claim 13, wherein:

the plurality of metal layer pieces include an adjacent metal layer piece joined to a side surface of the proximate metal layer piece that is closer to the pump chamber metal layer piece, and the adjacent metal layer piece is formed with a communication opening having a peripheral edge lying in close contact with a peripheral edge of a first passage forming opening among the plurality of passage forming openings.

15. A pump unit, comprising:

a pump including a piezoelectric element and a discharge mechanism for discharging fluid according to operation of the piezoelectric element; and a valve mechanism attached to the pump, wherein:

the discharge mechanism includes a pump body, a pump side diaphragm defining a pump chamber in cooperation with the pump body, at least one flow-in valve that is disposed in a flow-in passage defined in the pump body and connecting with the pump chamber, and a flow-out valve that is disposed in a flow-out passage defined in the pump body and connecting with the pump chamber;

the valve mechanism includes a valve mechanism body having a flow-in side connection passage connecting with the flow-in passage, and a flow-out side connection passage connecting with the flow-out passage, and a valve side diaphragm disposed in the valve mechanism body and dividing the flow-in side connection passage from the flow-out side connection passage;

the flow-in valve is allowed to open when a pressure on an upstream side of the flow-in valve is greater than a pressure in the pump chamber;

the flow-out valve is allowed to open when the pressure in the pump chamber is greater than a pressure on a downstream side of the flow-out valve;

the valve side diaphragm is allowed to restrict flow of fluid through the flow-out side connection passage when a pressure in the flow-in side connection passage is greater than a pressure in the flow-out side connection passage;

the discharge mechanism and the valve mechanism each include a plurality of metal layer pieces stacked in a predetermined stacking direction and joined to one another by diffusion welding, the discharge mechanism and the valve mechanism being secured to each other by diffusion welding;

the plurality of metal layer pieces include a valve side diaphragm metal layer piece having the valve side diaphragm, and a recessed metal layer piece joined to the valve side diaphragm metal layer piece and formed with a defining recess having a defining portion that defines a movable area for the valve side diaphragm;

the valve side diaphragm metal layer piece includes a first connection opening connecting with the defining recess at an outside position of the defining portion in plan view looking at the pump unit in the stacking direction, and smaller than the defining portion in the plan view;

the recessed metal layer piece includes a second connection opening connecting with the defining recess at an outside position of the defining portion in the plan view, and smaller than the defining portion in the plan view;

the defining recess includes a pair of extension portions respectively extending and tapering from the defining portion to the first connection opening and the second connection opening in the plan view; and the recessed metal layer piece includes a projection projecting from a bottom surface of the defining recess toward the valve side diaphragm and disposed on a line connecting the first connection opening and the second connection opening, the projection overlapping the defining portion, in the plan view.

* * * * *